US009182712B2

(12) United States Patent
Murakami

(10) Patent No.: US 9,182,712 B2
(45) Date of Patent: Nov. 10, 2015

(54) FIXING DEVICE AND IMAGE FORMING APPARATUS

(71) Applicant: Oki Data Corporation, Tokyo (JP)

(72) Inventor: Tatsuya Murakami, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/334,046

(22) Filed: Jul. 17, 2014

(65) Prior Publication Data

US 2015/0030361 A1 Jan. 29, 2015

(30) Foreign Application Priority Data

Jul. 23, 2013 (JP) ..... 2013-152698

(51) Int. Cl.
*G03G 15/20* (2006.01)

(52) U.S. Cl.
CPC .... *G03G 15/2053* (2013.01); *G03G 2215/2009* (2013.01); *G03G 2215/2032* (2013.01); *G03G 2215/2041* (2013.01)

(58) Field of Classification Search
CPC ..... G03G 15/2053; G03G 15/2064; G03G 15/2017; G03G 15/206
USPC ..... 399/29, 293, 329
See application file for complete search history.

(56) References Cited

U.S. PATENT DOCUMENTS

| | | | | |
|---|---|---|---|---|
| 4,082,414 | A * | 4/1978 | Berg | 359/360 |
| 5,673,056 | A * | 9/1997 | Ramanujam et al. | 343/756 |
| 2011/0064493 | A1* | 3/2011 | Muramatsu et al. | 399/329 |
| 2011/0182634 | A1* | 7/2011 | Ishigaya et al. | 399/328 |
| 2012/0087688 | A1* | 4/2012 | Kubota | 399/69 |
| 2014/0072356 | A1* | 3/2014 | Murakami | 399/329 |

FOREIGN PATENT DOCUMENTS

JP 2012-058319 A 3/2012

* cited by examiner

*Primary Examiner* — Walter L Lindsay, Jr.
*Assistant Examiner* — Frederick Wenderoth
(74) *Attorney, Agent, or Firm* — Panitch Schwarze Belisario & Nadel LLP

(57) ABSTRACT

A fixing device includes an endless fixing belt, a first roller provided on an inner circumference side of the fixing belt, a second roller provided on the inner circumference side of the fixing belt and located upstream of the first roller in a conveying direction of a recording medium, a heat source provided on the inner circumference side of the fixing belt, a first reflecting portion provided between the heat source and the first roller, and a second reflecting portion provided between the heat source and the second roller. The second reflecting portion is provided apart from the first reflecting portion.

18 Claims, 14 Drawing Sheets

FIG. 7A
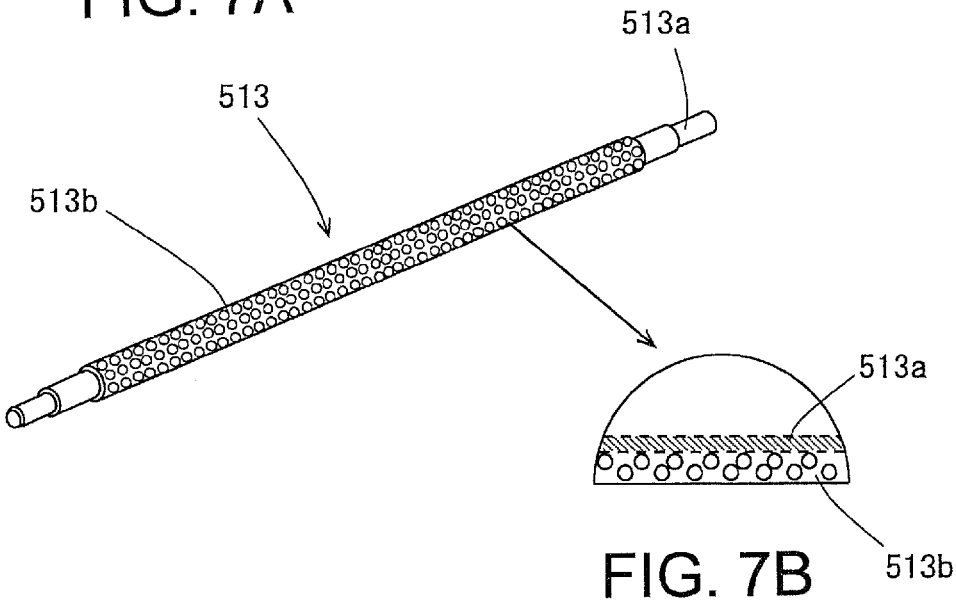
FIG. 7B
FIG. 8A
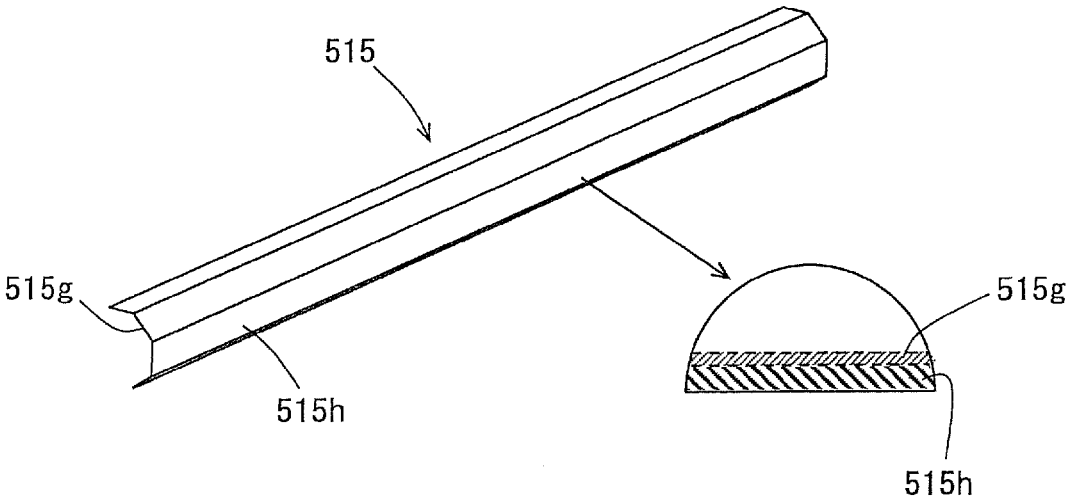
FIG. 8B

FIXING DEVICE AND IMAGE FORMING APPARATUS

BACKGROUND OF THE INVENTION

The present invention relates to a fixing device, and relates to an image forming apparatus such as a copier, a printer, a facsimile machine or an MFP (Multi-Function Peripheral) having the fixing device.

A fixing device is used in an electrophotographic image forming apparatus such as a copier, a printer, a facsimile machine or an MFP. The fixing device includes a fixing roller and a pressure roller paired with each other to form a nip portion. A heat source such as a halogen lamp is provided in the fixing roller. A recording sheet with an unfixed toner image is conveyed through the nip portion between the fixing roller and the pressure roller, and the unfixed toner is thermally fixed to the recording sheet by application of heat and pressure. Such a fixing device is disclosed in, for example, Japanese Laid-open Patent Publication No. 2012-58319 (see FIG. 1).

In the conventional fixing device, a fixing failure may occur. Therefore, enhancement of fixing property is desired.

SUMMARY OF THE INVENTION

An aspect of the present invention is intended to enhance fixing property.

According to an aspect of the present invention, there is provided a fixing device including an endless fixing belt, a first roller provided on an inner circumference side of the fixing belt, a second roller provided on the inner circumference side of the fixing belt and located upstream of the first roller in a conveying direction of a recording medium, a heat source provided on the inner circumference side of the fixing belt, a first reflecting portion provided between the heat source and the first roller, and a second reflecting portion provided between the heat source and the second roller. The second reflecting portion is provided apart from the first reflecting portion.

With such a configuration, enhancement of fixing property can be achieved.

BRIEF DESCRIPTION OF THE DRAWINGS

In the attached drawings:

FIG. 7A is an perspective view showing a driven roller according to Embodiment 1;

FIG. 7B is an enlarged sectional view showing a part of the driven roller according to Embodiment 1;

FIG. 8A is an perspective view showing a reflecting plate according to Embodiment 1;

FIG. 8B is an enlarged sectional view showing a part of the reflecting plate according to Embodiment 1;

DETAILED DESCRIPTION OF THE PREFERRED EMBODIMENT

Embodiment 1

Figure 1:
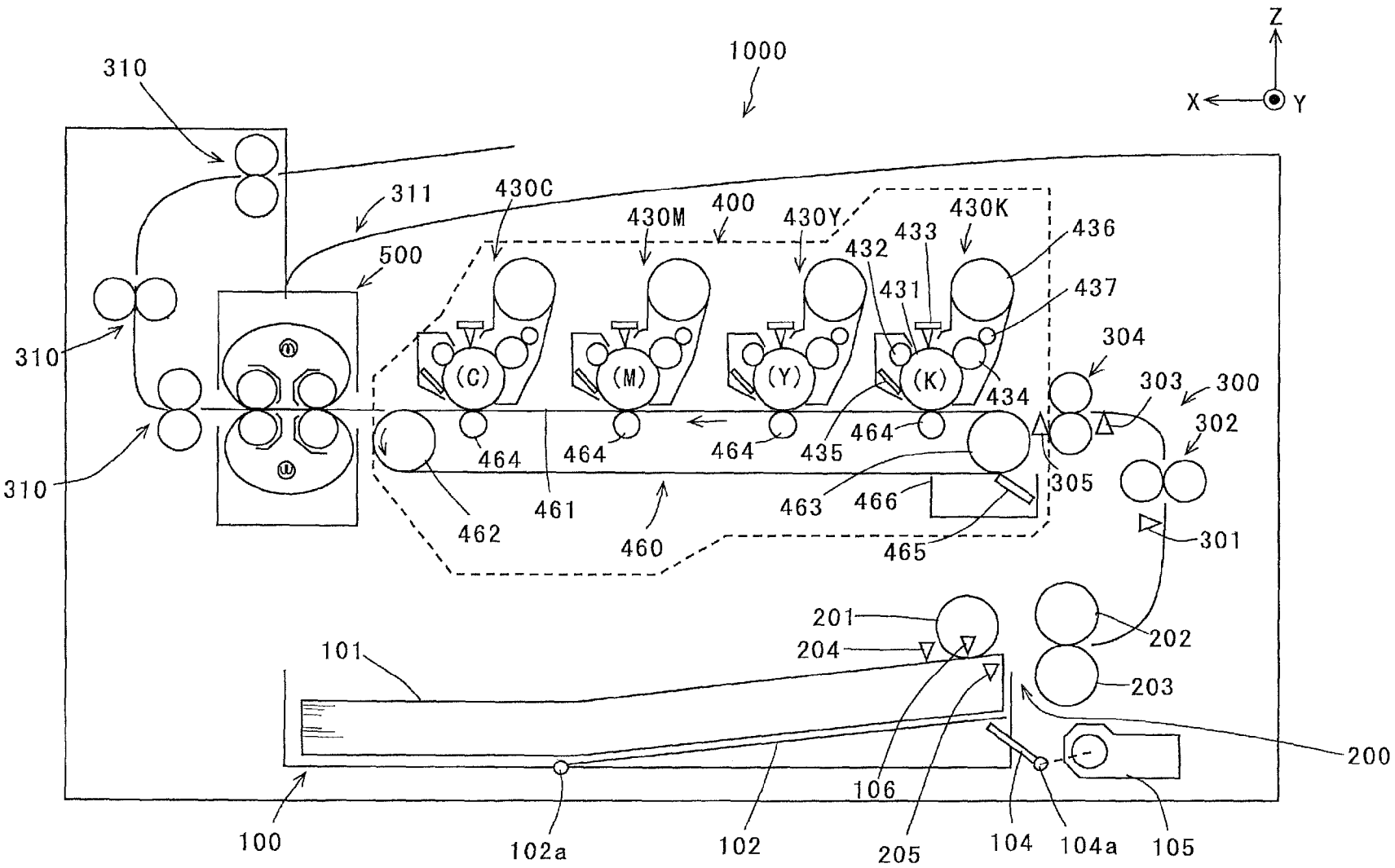
FIG. 1 is a view showing a configuration of an image forming apparatus according to Embodiment 1 of the present invention.

FIG. 1 is a view showing a configuration of an image forming apparatus 1000 according to Embodiment 1 of the present invention.

The image forming apparatus 1000 shown in FIG. 1 is configured as, for example, a color electrophotographic printer. As shown in FIG. 1, a sheet feeding tray 100 (i.e., a medium storage portion) is detachably mounted to a main part of the image forming apparatus 1000. The sheet feeding tray 100 stores recording sheets 101 as recording media therein. The sheet feeding tray 100 includes a sheet placing plate 102 for placing the recording sheets 101. The sheet placing plate 102 is rotatably supported by a support shaft 102*a* provided in the sheet feeding tray 100. The sheet feeding tray 100 further includes guide members (not shown) that guide the recording sheets 101 in a feeding direction and a direction perpendicular to the feeding direction so as to determine a placing position of the recording sheets 101.

A lift-up lever 104 is provided on a sheet feeding side of the sheet feeding tray 100. The lift-up lever 104 is rotatably supported by a support shaft 104*a*. The support shaft 104*a* is engageable with a motor 105. When the sheet feeding tray 100 is mounted to the main body of the image forming apparatus 1000, the lift-up lever 104 engages the motor 105, and a control unit (not shown) drives the motor 105. As the motor 105 is driven, the lift-up lever 104 is rotated upward, and a tip of the lift-up lever 104 pushes a bottom of the sheet placing plate 102. Therefore, the sheet placing plate 102 rotates upward about the support shaft 102*a*. When the recording sheets 101 reach a predetermined height, a rise detection unit 106 detects that the recording sheets 101 reach the predetermined height. Then, the control unit stops the rotation of the motor 105 based on detection signal of the rise detection unit 106.

A sheet feeding unit 200 (i.e., a medium feeding unit) is provided on the sheet feeding side (i.e., a right side in FIG. 1)

of the sheet feeding tray 100. The sheet feeding unit 200 feeds the recording sheets 101 one by one from the sheet feeding tray 100. The sheet feeding unit 200 includes a pickup roller 201 provided so as to contact the recording sheet 101 reaching the predetermined height. The pickup roller 201 rotates to feed the recording sheet 101 from the sheet feeding tray 100. The sheet feeding unit 200 further includes a feed roller 202 and a retard roller 203 that separate individual recording sheets 101 fed by the pickup roller 201.

Each recording sheet 101 fed from the sheet feeding unit 200 reaches a sheet conveying unit 300 (i.e., a medium conveying unit). To be more specific, the recording sheet 101 passes a sheet sensor 301, and reaches to a pair of conveying rollers 302. The conveying rollers 302 are driven by a not shown actuator, and start rotating at a timing (i.e., a delayed timing) when a predetermined time elapses after a leading edge of the recording sheet 101 is detected by the sheet sensor 301. The recording sheet 101 is pushed into a nip portion between the conveying rollers 302 in such a manner that the recording sheet 101 is slightly deflected, so that a skew of the recording sheet 101 is corrected. The recording sheet 101 conveyed by the conveying rollers 302 passes a sheet sensor 303, and reaches a pair of conveying rollers 304. The conveying rollers 304 are driven by the not shown actuator, and start rotating when the leading edge of the recording sheet 101 is detected by the sheet sensor 303. The conveying rollers 304 convey the recording sheet 101 without stopping the recording sheet 101. The recording sheet 101 conveyed by the conveying rollers 304 passes a writing sensor 305, and reaches an image forming section 400.

The image forming section 400 includes image forming units 430K, 430Y, 430M and 430C arranged in a line in this order from upstream along a conveying direction of the recording sheet 101 (i.e., right to left in FIG. 1). The image forming unit 430K stores a toner (i.e., a developer) of black (K). The image forming unit 430Y stores a toner of yellow (Y). The image forming unit 430M stores a toner of magenta (M). The image forming unit 430C stores a toner of cyanogen (C). The image forming units 430K, 430Y, 430M and 430C may be collectively referred to as the image forming units 430 when the image forming units 430K, 430Y, 430M and 430C need not be distinguished from each other. The image forming section 400 further includes a transfer unit 460 that transfers toner images (i.e., developer images) formed by the image forming units 430 to an upper surface of the recording sheet 101 by Coulomb force.

The image forming units 430K, 430Y, 430M and 430C have the same configurations except for the toners (i.e., black (K), yellow (Y), magenta (M) and cyan (C)). Therefore, the configuration of the image forming unit 430K of black (K) arranged at an upstream end in the conveying direction of the recording sheet 101 will be herein described.

The image forming unit 430 includes a photosensitive drum 431, a charging roller 432, an LED head 433, a developing roller 434, a supply roller 437 and a cleaning blade 435. The photosensitive drum 431 (i.e., an image bearing member) bears a toner image. The charging roller 432 (i.e., a charging member) uniformly charges a surface of the photosensitive drum 431. The LED head 433 (i.e., an exposure unit) includes an LED (Light Emitting Diode) array, and emits light so as to expose the surface of the photosensitive drum 431 to form a latent image (i.e., an electrostatic latent image). The developing roller 434 (i.e., a developer bearing body) develops the latent image with the frictionally charged toner. The toner storage unit 436 (i.e., a developer storage unit) replenishes the toner to the developing roller 434 and the supply roller 437. The supply roller 437 (i.e., a developer supply member) supplies the toner from the toner storage unit 436 to the developing roller 434. The cleaning blade 435 scrapes off the toner (i.e., a residual toner) that remains on the surface of the photosensitive drum 431 after transferring of the toner image.

The transfer unit 460 includes an endless transfer belt 461, a driving roller 462, a tensioning roller 463, four transfer rollers 464, a cleaning blade 465, and a toner box 466. The transfer belt 461 electrostatically adsorbs the recording sheet 101 and conveys the recording sheet 101. The driving roller 462 is driven by a not shown actuator, and rotates in a direction shown by an arrow to move the transfer belt 461. The tensioning roller 463 pairs with the driving roller 462, and applies a tension to the transfer belt 461. The transfer rollers 464 are pressed against the photosensitive drums 431 of the image forming units 430K, 430Y, 430M and 430C. The transfer rollers 464 are applied with a transfer voltage so as to transfer the toner images of the respective colors from the photosensitive drums 431 to the recording sheet 101. The cleaning blade 465 scrapes off the toner adhering to the transfer belt 461. The toner box 466 reserves the toner scraped off by the cleaning blade 465.

The image forming unit 430 and the transfer belt 461 are driven in synchronization with each other, and transfer the toner images of respective colors from the photosensitive drums 431 to the recording sheet 101 electrostatically adsorbed by the transfer belt 461. Then, the recording sheet 101 to which the toner image is transferred in the image forming section 400 is conveyed to the fixing unit 500 as a fixing device. The fixing unit 500 fixes the toner image to the recording sheet 101.

The fixing unit 500 applies heat and pressure to the toner image on the recording sheet 101 conveyed from the image forming section 400 in the conveying direction of the recording sheet 101. With application of heat and pressure, the toner image is molten, and is fixed to the recording sheet 101. Then, the recording sheet 101 to which the toner image has been fixed is ejected outside the image forming apparatus 1000 by ejection rollers 310. The ejected recording sheet 101 is placed on a stacker portion 311. A configuration of the fixing unit 500 will be later described in detail.

In this regard, an X direction, a Y direction and a Z direction are defined in FIG. 1. To be more specific, the X direction is a defined as the conveying direction of the recording sheet 101 when the recording sheet 101 passes the image forming section 400. The Y direction is defined as a direction parallel to a rotation axis of the photosensitive drum 431. The Z direction is defined as a direction perpendicular to the X direction and the Y direction. In other drawings, the X direction, the Y direction and the Z direction indicate the same directions as those shown in FIG. 1. That is, in the subsequent drawings, the X direction, the Y direction and the Z direction indicate directions of components in a state where the components are assembled into the image forming apparatus 1000 shown in FIG. 1. Further, in this example, the Z direction is a substantially vertical direction.

Figure 2:
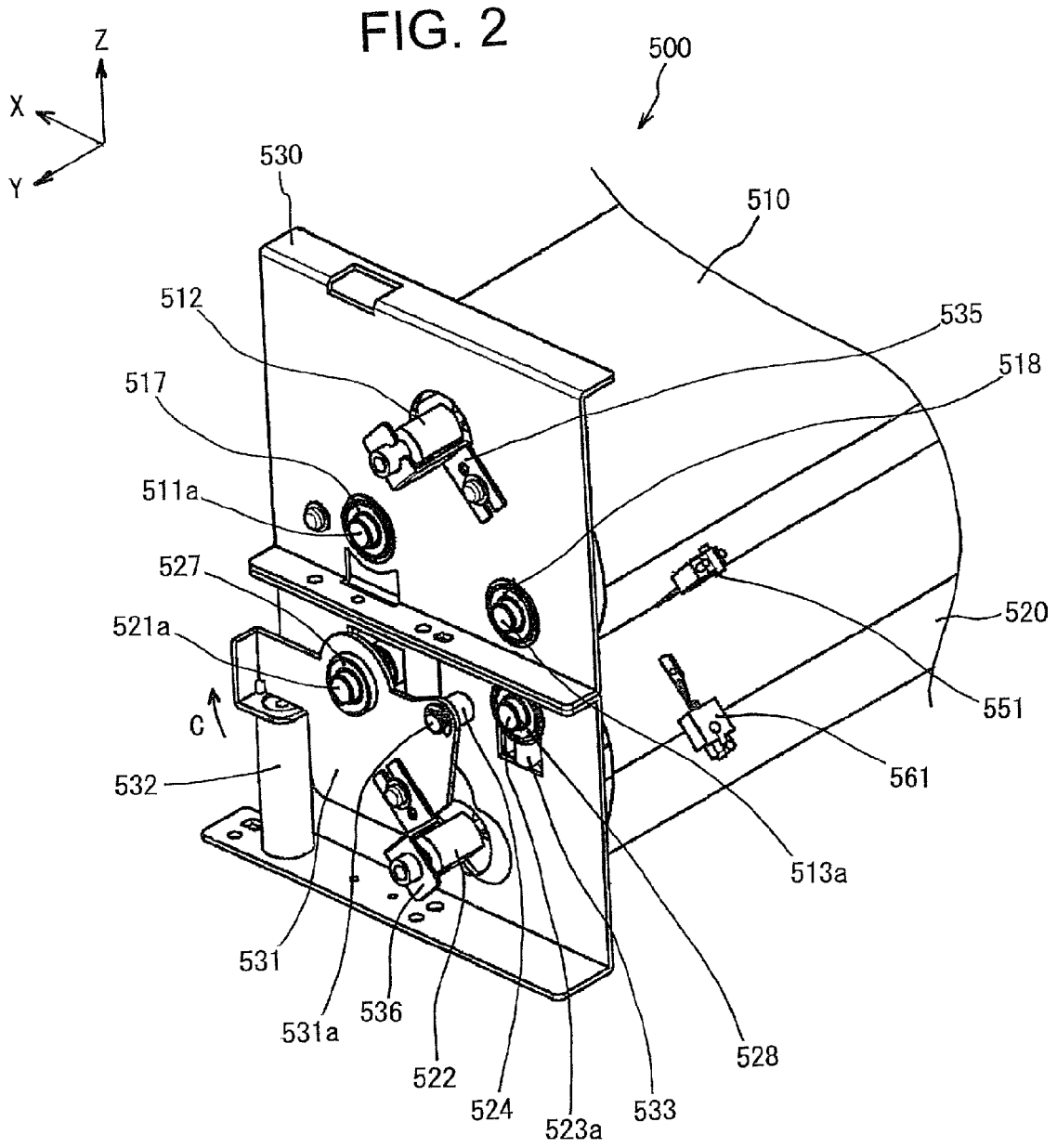
FIG. 2 is a perspective view showing a left end portion of a fixing unit according to Embodiment 1.
Figure 3:
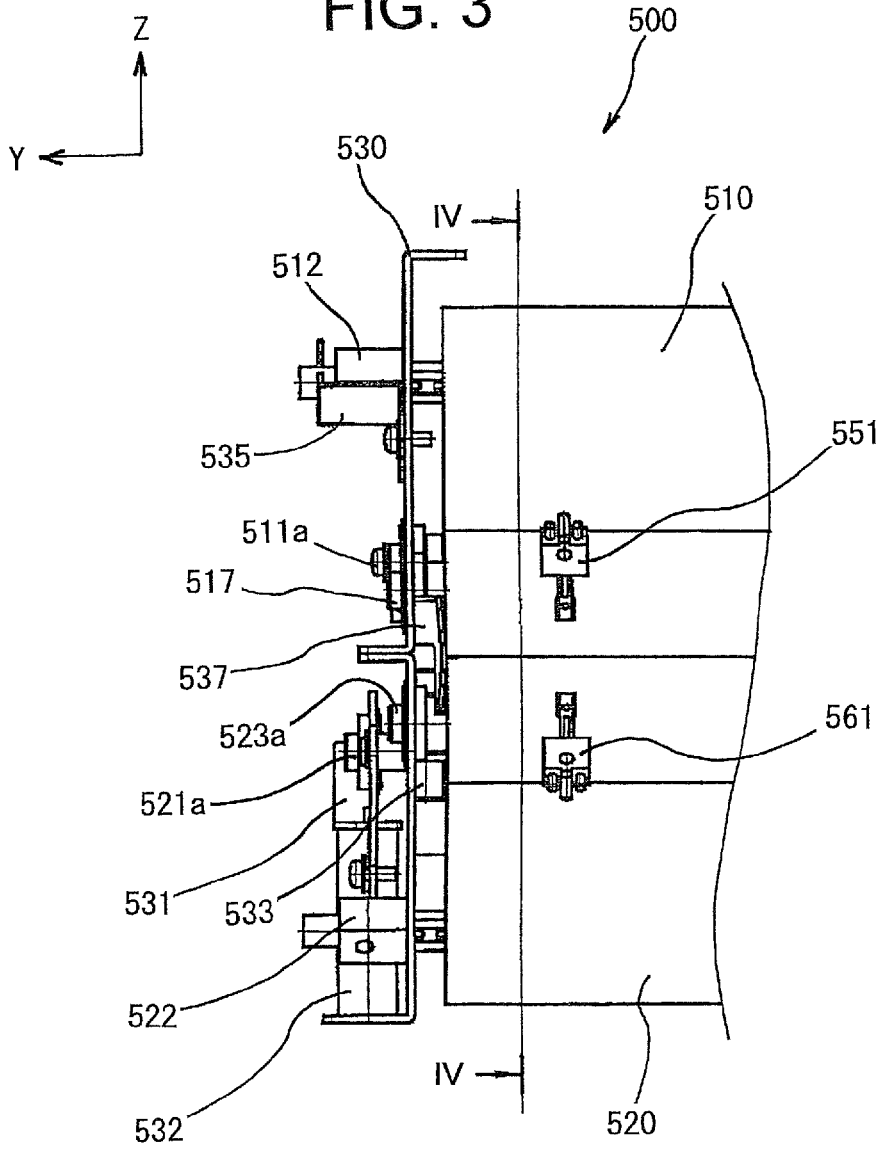
FIG. 3 is a front view showing the left end portion of the fixing unit shown in FIG. 2 as seen from −X side.
Figure 4:
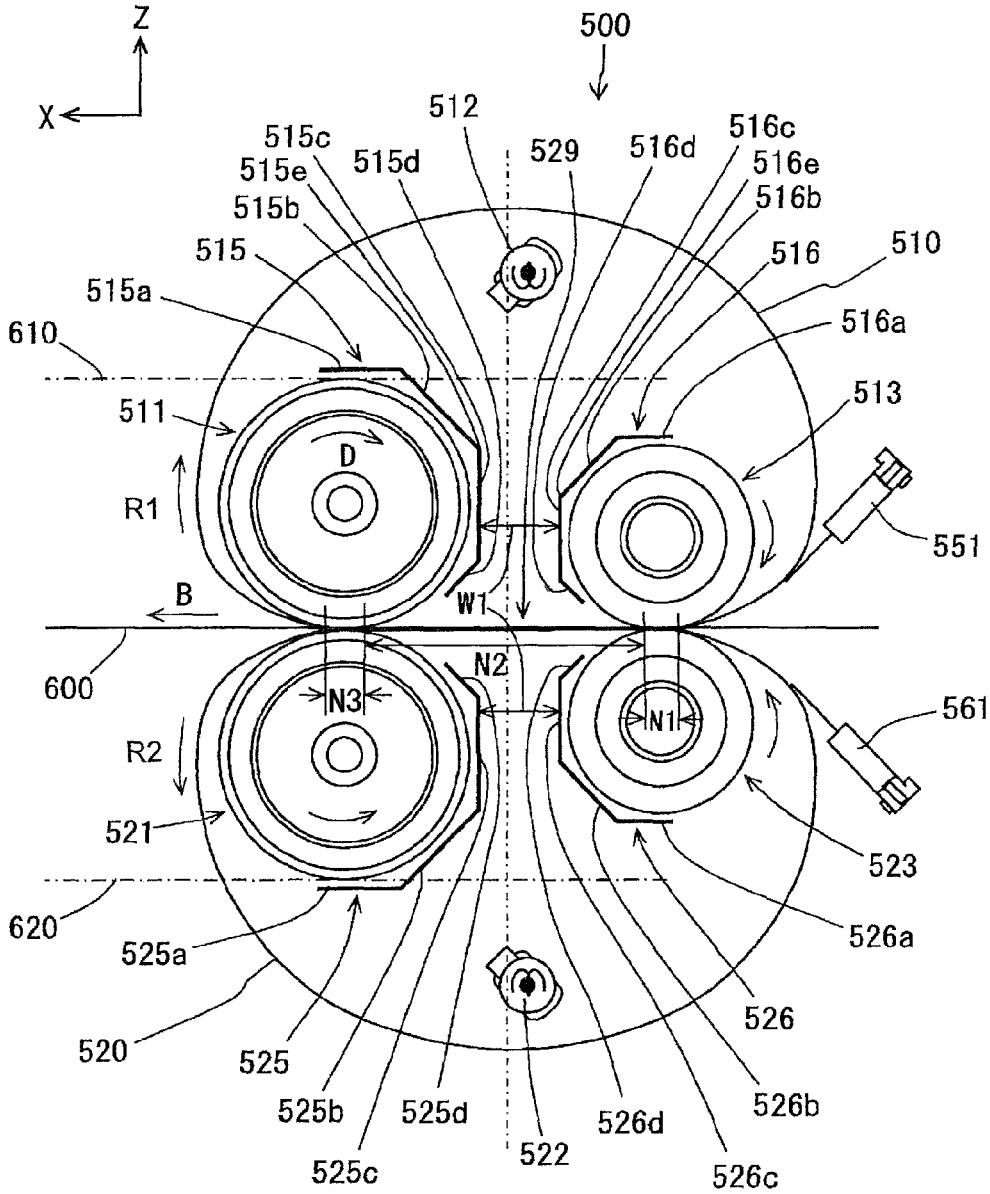
FIG. 4 is a sectional view of the fixing unit according to Embodiment 1 taken along a plane indicated by line IV-IV in FIG. 3.

FIG. 2 is a perspective view showing a left end portion of the fixing unit 500 according to Embodiment 1. FIG. 3 is a front view of the left end portion of the fixing unit 500 as seen from −X side. FIG. 4 is a sectional view showing the fixing unit 500 taken along a plane indicated by lines IV-IV in FIG. 3. The configuration of the fixing unit 500 will be described with reference to FIGS. 2 through 4.

As shown in FIG. 4, the fixing unit 500 includes an endless fixing belt 510 and an endless pressure belt 520. A driving roller 511 as a first roller and a driven roller 513 as a second roller are provided inside (i.e., provided on an inner circumference side of) the fixing belt 510. The driving roller 511 and the driven roller 513 contact an inner circumferential surface of the fixing belt 510, and support a straight path of the fixing belt 510. A pressure roller 521 as a third roller and a driven pressure roller 523 as a fourth roller are provided inside (i.e., provided on an inner circumference side of) the pressure belt 520. The pressure roller 521 and the driven pressure roller 523 contact an inner circumferential surface of the pressure belt 520, and support a straight path of the pressure belt 520. Here, an outer diameter of the driving roller 511 is greater than an outer diameter of the driven roller 513. An outer diameter of the pressure roller 521 is the same as the outer diameter of the driving roller 511. An outer diameter of the driven pressure roller 523 is the same as the outer diameter of the driven roller 513.

The driving roller 511 and the pressure roller 521 are pressed against each other via the fixing belt 510 and the pressure belt 520. The driving roller 511 and the pressure roller 521 are provided downstream in the conveying direction of the recording sheet 101 (indicated by an arrow B). The driven roller 513 and the driven pressure roller 523 are pressed against each other via the fixing belt 510 and the pressure belt 520. The driven roller 513 and the driven pressure roller 523 are provided upstream in the conveying direction of the recording sheet 101. A pressing portion between the driving roller 511 and the pressure roller 521 and a pressing portion between the driven roller 513 and the driven pressure roller 523 are arranged on a straight line along the conveying direction of the recording sheet 101. With such an arrangement, a fixing nip region 529 is formed. The fixing nip region 529 extends from the pressing portion between the driven roller 513 and the driven pressure roller 523 to the pressing portion between the driving roller 511 and the pressure roller 521. The outer diameters of the driving roller 511 and the pressure roller 521 are larger than the outer diameters of the driven roller 513 and the driven pressure roller 523.

In this regard, the fixing belt 510 is not stretched around the driving roller 511 and the driven roller 513, but is supported in a free state. Similarly, the pressure belt 520 is not stretched around the pressure roller 521 and the driven pressure roller 523, but is supported in a free state. In this regard, the "free state" is a state where the fixing belt 510 and the pressure belt 520 are not stretched (i.e., no tension is applied to the fixing belt 510 and the pressure belt 520) except for the fixing nip region 529. It is said that the fixing belt 510 and the pressure belt 520 respectively form a free nip. For this purpose, the fixing belt 510 and the pressure belt 520 preferably have appropriate rigidity and flexibility as described later.

In this way, the fixing nip region 529 is formed by a first roller pair (i.e., the driving roller 511 and the pressure roller 521), a second roller pair (i.e., the driven roller 513 and the driven pressure roller 523) and the fixing belt 510 and the pressure belt 520 sandwiched by each of the first roller pair and the second roller pair.

A rotation shaft 511*a* (FIG. 2) of the driving roller 511 provided inside the fixing belt 510 is rotatably supported by a bracket 530 via a bearing 517. Similarly, a rotation shaft 513*a* of the driven roller 513 is rotatably supported by the bracket 530 via a bearing 518.

A rotation shaft 521*a* (FIG. 2) of the pressure roller 521 provided inside the pressure belt 520 is rotatably supported by a pressure roller lever 531 via a bearing 527. The pressure roller lever 531 has a shaft portion 531*a* at an end portion thereof. The shaft portion 531*a* is rotatably supported by the bracket 530 via a bearing 524. The other end portion of the pressure roller lever 531 is biased by a spring 532 in a direction shown by an arrow C. The spring 532 is compressed between the end portion of the pressure roller lever 531 and the bracket 530. With a biasing force of the spring 532, the pressure roller 521 is pressed against the driving roller 511 via the fixing belt 510 and the pressure belt 520 with a predetermined pressing force, and a nip portion N3 is formed.

A rotation shaft 523*a* (FIG. 2) of the driven pressure roller 523 provided inside the pressure belt 520 is rotatably supported by a bearing 528. The bearing 528 is movably supported by the bracket 530, and is biased in +Z direction by a spring 533. The spring 533 is compressed between the bearing 528 and the bracket 530. With a biasing force of the spring 533, the driven pressure roller 523 is pressed against the driven roller 513 via the fixing belt 510 and the pressure belt 520 with a predetermined pressing force, and a nip portion N1 is formed.

As described above, the pressure roller 521 is biased by the spring 532, and the driven pressure roller 523 is biased by the spring 533. The fixing nip region 529 includes the nip portion N3 formed by the first roller pair (i.e., the driving roller 511 and the pressure roller 521), the nip portion N1 formed by the second roller pair (i.e., the driven roller 513 and the driven pressure roller 523), and a nip portion N2 formed by the fixing belt 510 and the pressure belt 520 having appropriate rigidity and flexibility at intermediate portions between the nip portion N1 and the nip portion N3. The pressure belt 520, the pressure roller 521 and the driven pressure roller 523 correspond to a nip forming portion that forms the nip region 529 with the fixing belt 510, the driving roller 511 and the driven roller 513.

The pressing portions of the first roller pair (i.e., the driving roller 511 and the pressure roller 521) and the second roller pair (i.e., the driven roller 513 and the driven pressure roller 523) are arranged substantially on the same plane in the fixing nip region 529 (FIG. 4) so as not to apply stress to the fixing belt 510 and the pressure belt 520. The fixing nip region 529 including the nip portions N1, N2 and N3 forms a straight conveying portion for the recording sheet 101 which is substantially parallel with the conveying direction of the recording sheet 101.

In this regard, description has been made of one ends of the driving roller 511, the driven roller 513, the pressure roller 521, and the driven pressure roller 523 supported by the bracket 530 on the left side of the fixing unit 500. The other ends these rollers are supported by a bracket (not shown) on the right side of the fixing unit 500 in a similar manner. That is, supporting structures (i.e., the brackets 530, the bearings, the springs and the like) on the left side and the right side of the fixing unit 500 are substantially plane-symmetrical to each other with respect to, for example, an imaginary plane passing through a center portion of the driving roller 511 perpendicularly to the axial direction of the driving roller 511.

A heater 512 as a heat source is provided inside the fixing belt 510. In a particular example, a halogen lamp is used as the heater 512. Here, a nip base line 600 is defined as a line parallel to the X direction and passing through the fixing nip region 529. The heater 512 is located on an outer side (on a side opposite to the fixing nip portion 529) with respect to a tangential line 610 of the driving roller 511 parallel to the nip base line 600, and is located between the driving roller 511 and the driven roller 513. That is, the heater 512 is located so that the heater 512 can irradiate a wider region of the inner circumferential surface of the fixing belt 510. Both end portions of the heater 512 are supported by heater support portions 535 (one of which is shown in FIG. 2) provided on the brackets 530 (FIG. 2).

As shown in FIG. 4, a reflecting plate 515 as a first reflecting portion is provided between the heater 512 and the driving roller 511. A reflecting plate 516 as a second reflecting portion is provided between the heater 512 and the driven roller 513. The reflecting plate 515 and the reflecting plate 516 are respectively formed along outer circumferences of the driving roller 511 and the driven roller 513 so as not to contact the driving roller 511 and the driven roller 513 taking into consideration thermal expansion, rotation deviation or the like. The reflecting plate 515 and the reflecting plate 516 respectively cover the driving roller 511 and the driven roller 513 to prevent rubber layers of the driving roller 511 and the driven roller 513 from being directly irradiated with light emitted by the heater 512.

The reflecting plate 515 and the reflecting plate 516 are located apart from each other, and leave a gap W1 in the conveying direction of the recording sheet 101 (i.e., the X direction). In other words, a reflecting surface 515*c* as a first reflecting surface of the reflecting plate 515 and a reflecting surface 516*c* as a second reflecting surface of the reflecting plate 516 face each other in a region between the driving roller 511 and the driven roller 513. The reflecting surfaces 515*c* and 516*c* extend perpendicularly to the nip base line 600. Therefore, both extension lines of the reflecting surface 515*c* and the reflecting surface 516*c* are directed to the heater 512 and to the nip portion N2. Accordingly, light emitted by the heater 512 proceeds between the reflecting surface 515*c* of the reflecting plate 515 and the reflecting surfaces 516*c* of the reflecting plate 516. As a result, the light emitted by the heater 512 is incident on the nip portion N2 of the fixing belt 510 directly or after being reflected by the reflecting surfaces 515*c* and 516*c* via the gap W1 through which the heater 512 faces the fixing belt 510.

The reflecting plate 515 further includes a reflecting surface 515*b* as a third reflecting surface formed continuously with the reflecting surface 515*c*. A boundary portion between the reflecting surface 515*b* and the reflecting surface 515*c* is referred to as a boundary portion 515*e* (i.e., a first boundary portion). The reflecting surface 515*b* is formed at a position where the reflecting surface 515*c* is rotated counterclockwise by 45 degrees about a rotation axis of the driving roller 511. The reflecting surface 515*b* is located between the heater 512 and the driving roller 511. The reflecting plate 515 further includes a reflecting surface 515*a* formed continuously with the reflecting surface 515*b*. The reflecting surface 515*a* is formed at a position where the reflecting surface 515*b* is rotated counterclockwise by 45 degrees about the rotation axis of the driving roller 511. That is, the reflecting surface 515*a* is parallel with the nip base line 600. The reflecting plate 515 further includes a reflecting surface 515*d* formed continuously with the reflecting surface 515*c*. The reflecting surface 515*d* is formed at a position where the reflecting surface 515*c* is rotated clockwise by 45 degrees about the rotation axis of the driving roller 511.

Similarly, the reflecting plate 516 includes a reflecting surface 516*b* as a fourth reflecting surface formed continuously with the reflecting surfaces 516*c*. A boundary portion between the reflecting surface 516*b* and the reflecting surface 516*c* is referred to as a boundary portion 516*e* (i.e., a second boundary portion). The reflecting surface 516*b* is formed at a position where the reflecting surface 516*c* is rotated clockwise by 45 degrees about a rotation axis of the driven roller 513. The reflecting surface 516*b* is located between the heater 512 and the driven roller 513. The reflecting plate 516 further includes a reflecting surface 516*a* formed continuously with the reflecting surface 516*b*. The reflecting surface 516*a* is formed at a position where the reflecting surface 516*b* is rotated clockwise by 45 degrees about the rotation axis of the driven roller 513. That is, the reflecting surface 516*a* is parallel with the nip base line 600. The reflecting plate 516 further includes a reflecting surface 516*d* formed continuously with the reflecting surface 516*c*. The reflecting surface 516*d* is formed at a position where the reflecting surface 516*c* is rotated counterclockwise by 45 degrees about the rotation axis of the driven roller 513.

The reflecting surface 515*b* of the reflecting plate 515 protrudes toward the heater 512 with respect to the reflecting plate 516 in a direction perpendicular to the nip base line 600. The reflecting surface 515*c* of the reflecting plate 515 faces the boundary portion 516*e* (i.e., a bent portion) between the reflecting surface 516*c* and the reflecting surface 516*b* in the conveying direction of the recording sheet 101. In other words, the reflecting surface 515*c* extends toward the heater 512 with respect to the boundary portion 516*e*. That is, the boundary portion 515*e* is closer to the heater 512 than the boundary portion 516*e* is.

In this regard, widths of the reflecting surfaces 515*a* and 515*d* and widths of the reflecting surfaces 516*a* and 516*d* are set to be appropriately short as described later.

A thermistor 551 (i.e., a temperature detection unit) is provided in contact with or in the vicinity of an outer circumferential surface of the fixing belt 510 for detecting a surface temperature of the fixing belt 510.

A heater 522 is provided inside the pressure belt 520. In a particular example, the halogen lamp is used as the heater 522. This heater 522 is located on an outer side (i.e., on a side opposite to the fixing nip portion 529) with respect to a tangential line 620 of the pressure roller 521 parallel to the nip base line 600, and is located between the pressure roller 521 and the driven pressure roller 523. That is, the heater 522 is located so that the heater 522 can irradiate a wider region of the inner circumferential surface of the pressure belt 520. Both end portions of the heater 522 are supported by heater support portions 536 (one of which is shown in FIG. 2) provided on the pressure roller levers 531 (FIG. 2).

As shown in FIG. 4, a reflecting plate 525 is provided between the heater 522 and the pressure roller 521. A reflecting plate 526 is provided between the heater 522 and the driven pressure roller 523. The reflecting plate 525 and the reflecting plate 526 are respectively formed along outer circumferences of the pressure roller 521 and the driven pressure roller 523 so as not to contact the pressure roller 521 and the driven pressure roller 523 taking into consideration thermal expansion, rotation deviation or the like. The reflecting plate 525 and the reflecting plate 526 respectively cover the pressure roller 521 and the driven pressure roller 523 to prevent rubber layers of the pressure roller 521 and the driven pressure roller 523 from being directly irradiated with light emitted by the heater 522.

The reflecting plate 525 and the reflecting plate 526 are located apart from each other, and leave a gap W1 in the conveying direction of the recording sheet 101 (i.e., the X direction). In other words, a reflecting surface 525*c* of the reflecting plate 525 and a reflecting surface 526*c* of the reflecting plate 526 face each other in a region between the pressure roller 521 and the driven pressure roller 523. The reflecting surfaces 525*c* and 526*c* extend perpendicularly to the nip base line 600. Therefore, both extension lines of the reflecting surface 525*c* and the reflecting surface 526*c* are directed to the heater 522 and to the nip portion N2. Accordingly, light emitted by the heater 522 proceeds between the reflecting surface 525*c* of the reflecting plate 525 and the reflecting surface 526*c* of the reflecting plate 526. As a result, the light emitted by the heater 522 is incident on the nip portion N2 of the pressure belt 520 directly or after being reflected by the reflecting surfaces 525*c* and 526*c* via the gap W1 through which the fixing belt 510 faces the heater 522.

The reflecting plate 525 includes a reflecting surface 525*b* formed continuously with the reflecting surfaces 525*c*. The reflecting surface 525*c* is formed at a position where the reflecting surface 525*c* is rotated clockwise by 45 degrees about a rotation axis of the pressure roller 521. The reflecting surface 525*b* is located between the heater 522 and the pressure roller 521. The reflecting plate 525 further includes a reflecting surface 525*a* formed continuously with the reflecting surface 525*b*. The reflecting surface 525*a* is formed at a position where the reflecting surface 525*b* is rotated clockwise by 45 degrees about the rotation axis of the pressure roller 521. That is, the reflecting surface 525*a* is parallel with the nip base line 600. The reflecting plate 525 further includes a reflecting surface 525*d* formed continuously with the reflecting surface 525*c*. The reflecting surface 525*d* is formed at a position where the reflecting surface 525*c* is rotated counterclockwise by 45 degrees about the rotation axis of the pressure roller 521.

Similarly, the reflecting plate 526 includes a reflecting surface 526*b* formed continuously with the reflecting surface 526*c*. The reflecting surface 526*b* is formed at a position where the reflecting surface 526*c* is rotated counterclockwise by 45 degrees about a rotation axis of the driven pressure roller 523. The reflecting surface 526*b* is located between the heater 522 and the driven pressure roller 523. The reflecting plate 526 further includes a reflecting surface 526*a* formed continuously with the reflecting surface 526*b*. The reflecting surface 526*a* is formed at a position where the reflecting surface 526*b* is rotated counterclockwise by 45 degrees about the rotation axis of the driven pressure roller 523. The reflecting surface 526*a* is parallel with the nip base line 600. The reflecting plate 526 further includes a reflecting surface 526*d* formed continuously with the reflecting surface 526*c*. The reflecting surface 526*d* is formed at a position where the reflecting surface 526*c* is rotated clockwise by 45 degrees about the rotation axis of the driven pressure roller 523.

The reflecting surface 525*b* of the reflecting plate 525 protrudes toward the heater 522 with respect to the reflecting plate 526 in a direction perpendicular to the nip base line 600. The reflecting surface 525*c* of the reflecting plate 525 faces a boundary portion (i.e., a bent portion) between the reflecting surface 526*c* and the reflecting surface 526*b* in the conveying direction of the recording sheet 101. In other words, the reflecting surface 525*c* extends toward the heater 522 with respect to the boundary portion.

In this regard, widths of the reflecting surfaces 525*a* and 525*d* and widths of the reflecting surfaces 526*a* and 526*d* are set to be appropriately short.

A thermistor 561 is provided in contact with or in the vicinity of the pressure belt 520 for detecting a surface temperature of the pressure belt 520.

Next, main components of the fixing unit 500 of this embodiment will be described.

Figure 5A:
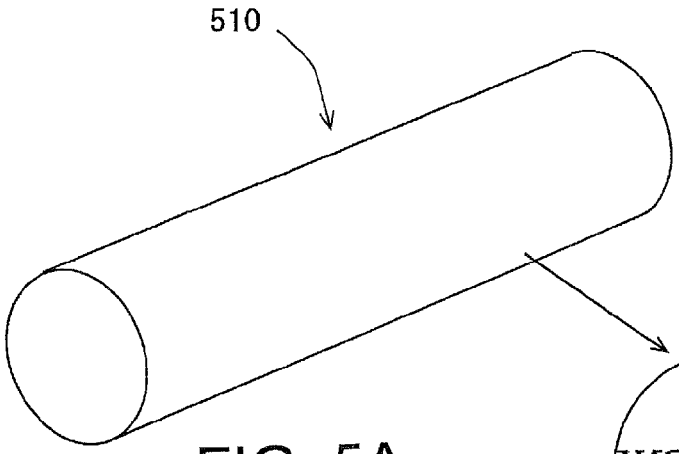
FIG. 5A is an perspective view showing a fixing belt according to Embodiment 1.
Figure 5B:
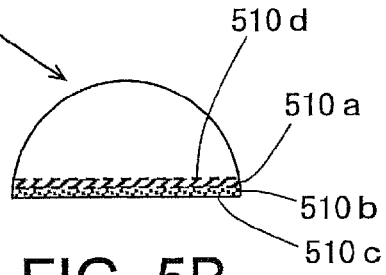
FIG. 5B is an enlarged sectional view showing a part of the fixing belt according to Embodiment 1.

FIG. 5A is a perspective view showing the fixing belt 510. FIG. 5B is an enlarged sectional view showing a part of the fixing belt 510. The fixing belt 510 and the pressure belt 520 have the same structure, and therefore the structure of the fixing belt 510 will be herein described.

The fixing belt 510 includes a base material 510*a* on the inner circumference thereof. A resilient layer 510*b* is formed on an outer circumferential surface of the base material 510*a*. A releasing layer 510*c* is formed on an outer circumferential, surface of the resilient layer 510*b*. The base material 510*a* is an endless belt having a resiliency (elasticity), and is formed of metal such as stainless steel (SUS). The base material 510*a* preferably has a thickness in a range of approximately 40-70 μm, and preferably has appropriate rigidity and flexibility. The resilient layer 510*b* is formed of, for example, silicone rubber.

The releasing layer 510*c* is formed of fluorine-based resin such as PFA (tetra fluoro ethylene perfluoro alkyl vinyl ether copolymer), PTFE (poly tetra fluoro ethylene) or the like. The releasing layer 510*c* is formed by covering the resilient layer 510*b* with a tube or by applying coating on the resilient layer 510*b*. Further, an inner circumferential surface 510*d* of the fixing belt 510 is painted with black (i.e., coated with a black layer) so that the fixing belt 510 efficiently absorbs radiant heat of the heater 512. It is also possible to form the releasing layer 510*c* directly on the base material 510*a* without providing the resilient layer 510*b*.

Figure 6A:
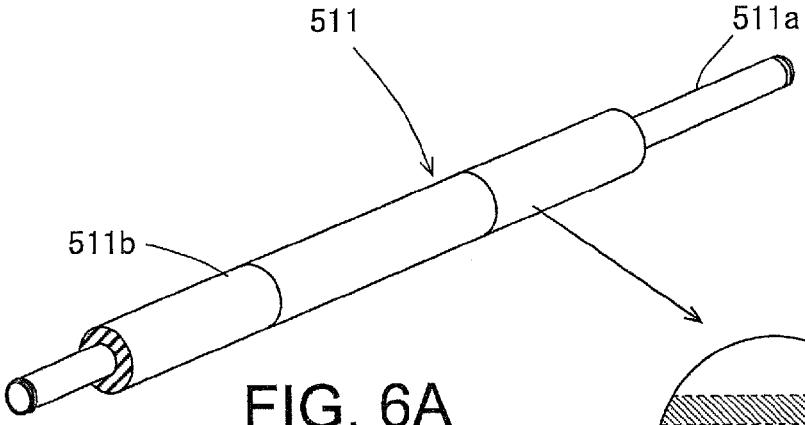
FIG. 6A is an perspective view showing a driving roller according to Embodiment 1.
Figure 6B:
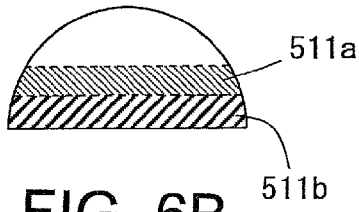
FIG. 6B is an enlarged sectional view showing a part of the driving roller according to Embodiment 1.

FIG. 6A is a perspective view showing the driving roller 511. FIG. 6B is an expanded sectional view showing a part of the driving roller 511. The driving roller 511 and the pressure roller 521 have the same structure, and therefore the structure of the driving roller 511 will be herein described.

The driving roller 511 includes a metal core 511*a* (i.e., a rotation shaft) formed of a pipe-like hollow member, and a resilient layer 511*b* formed on an outer circumferential surface of the metal core 511*a*. The metal core 511*a* is formed of, for example, STKM (i.e., carbon steel tube for mechanical structure). The resilient layer 511*b* is formed of silicone rubber having heat resistance. Although the metal core 511*a* is formed of iron (STKM) in this example, the metal core 511*a* may be formed of an aluminum pipe or may be formed of other metal such as SUM (i.e., sulfur and sulfur-composite free-cutting steel) and SUS (i.e., stainless steel). Further, the resilient layer 511*b* is formed of, for example, solid type (i.e., non-foam) silicone rubber whose ASKER-C hardness is in a range from 75 to 85 degrees.

The driving roller 511 and the pressure roller 521 facing each other have the same structure as described above, and therefore exhibit the same thermal expansion. Therefore, the fixing belt 510 and the pressure belt 520 are prevented from being applied with stress when the fixing belt 510 and the pressure belt 520 form the straight fixing nip region 529 therebetween.

FIG. 7A is a perspective view showing the driven roller 513. FIG. 7B is an expanded sectional view showing a part of the driven roller 513. The driven roller 513 and the driven pressure roller 523 have the same structure, and therefore the structure of the driven roller 513 will be herein described.

The driven roller 513 includes a metal core 513*a* (i.e., a rotation shaft) formed of a pipe-like hollow member, and a resilient layer 513*b* formed on an outer circumferential surface of the metal core 513*a*. The metal core 513*a* is formed of, for example, STKM. The resilient layer 513*b* is formed of foaming silicone rubber having heat resistance and insulation property. The driven roller 513 and the driven pressure roller 523 facing each other have the same structure as described above, and therefore exhibit the same thermal expansion. Therefore, the fixing belt 510 and the pressure belt 520 are prevented from being applied with stress when the fixing belt 510 and the pressure belt 520 form the straight fixing nip region 529 therebetween.

FIG. 8A is a perspective view showing the reflecting plate 515. FIG. 8B is an expanded sectional view showing a part of the reflecting plate 515. The reflecting plates 515 and 525 and the reflecting plates 516 and 526 are formed of the same material. Structures of the reflecting plates 515 and 525 and the reflecting plates 516 and 526 have been described above. Therefore, the material of the reflecting plate 515 will be herein described.

The reflecting plate 515 includes a base material 515*g* and a reflecting layer 515*h* formed on a surface of the base material 515*g*. The base material 515*g* is formed of, for example, an aluminum plate. The reflecting layer 515*h* is formed of, for example, high reflective aluminum vapor-deposited on the surface of the base material 515*g*. Further, silver may also be vapor-deposited on the surface of the high reflective aluminum in order to enhance reflectance. Since the reflecting plate 515 reflects the heat of high temperature from the halogen lamp, the base material 515*g* is required not to melt by the heat. For this reason, the base material 515*g* may be formed of SUS304BA having glossy surface and obtained by bright-annealing of a stainless steel having high melting point. Further, the base material 515*g* may be mirror-polished using polishing material of #700 or #800. In this case, the mirror-polished surface of the base material 515*g* is used as the reflecting surface, and therefore vapor deposition (for forming the reflection layer) can be eliminated.

A pair of belt guides 537 (one of which is shown in FIG. 3) are provided on both sides of the fixing belt 510 and the pressure belt 520. The belt guides 537 regulate displacements of the fixing belt 510 and the pressure belt 520, and correct skews of the fixing belt 510 and the pressure belt 520. Each belt guide 537 is positioned and fixed to the bracket 530 using a fixing mechanism (not shown) so that a gap is formed between the belt guide 537 and the fixing belt 510 and the pressure belt 520. The belt guides 537 slidably contact the fixing belt 510 and the pressure belt 520, and are used in high temperature environment in the fixing unit 500. Therefore, the belt guides 537 are required to have high tolerance to sliding contact and high heat resistance. For this reason, the belt guides 537 are formed of high-functional resin such as PPS (polyphenylene sulfide), LCP (liquid crystal polymer), PEEK (poly ether ether ketone) or PI (polyimide).

In the above described configuration, an operation of the fixing unit 500 will be herein described with reference to FIG. 4.

First, when the image forming apparatus 1000 starts a printing operation (i.e., an image forming operation), the driving roller 511 starts rotating in the fixing unit 500. In this regard, the driving roller 511 has a gear (not shown) integrally provided at a right end (i.e., an end on the −Y side) of the rotation shaft 511*a*. The gear meshes with a driving gear fixed to an output shaft of a fixing motor provided in the main body of the image forming apparatus 1000. The rotation of the fixing motor is transmitted to the gear of the rotation shaft 511*a* of the driving roller 511, and therefore the driving roller 511 starts rotating in a direction shown by an arrow D (FIG. 4) for conveying the recording sheet 101. As the driving roller 511 rotates in the direction shown by the arrow D, the fixing belt 510 rotates in a direction shown by an arrow R1 following the rotation of the driving roller 511 due to a frictional force between the driving roller 511 and the fixing belt 510. That is, the fixing belt 510 rotates in the same direction as the driving roller 511. An expression "rotation of the fixing belt 510" is used to mean that respective parts of the fixing belt 510 move in the direction shown by the arrow R1 while the fixing belt 510 entirely stays in the same position.

A rotation (i.e., movement) of the fixing belt 510 is transmitted to the driven roller 513. The driven roller 513 rotates in a direction shown by an arrow (i.e., a direction to convey the recording sheet 101) following the rotation of the fixing belt 510. At the nip portion N3, the rotation of the fixing belt 510 is transmitted to the pressure belt 520. Therefore, the pressure belt 520 rotates in a direction shown by an arrow R2 (i.e., a direction to convey the recording sheet 101) at the same speed as the fixing belt 510 following the rotation of the fixing belt 510. A rotation of the pressure belt 520 is transmitted to the pressure roller 521 and the driven pressure roller 523. Therefore, the pressure roller 521 and the driven pressure roller 523 rotate in directions respectively shown by arrows.

As shown in FIG. 4, the fixing belt 510 and the pressure belt 520 rotate in such a manner that the fixing belt 510 and the pressure belt 520 are slackened in non-nip regions (i.e., regions except for the fixing nip region 529). Since the base materials of the fixing belt 510 and the pressure belt 520 have resiliency (elasticity), the fixing belt 510 and the pressure belt 520 rotate while maintaining the slackened state.

The heater 512 provided inside the fixing belt 510 is applied with current by an electricity supply circuit (not shown), and generates heat. That is, the heater 512 heats the fixing belt 510 from inside. The surface temperature of the heated fixing belt 510 is detected by the thermistor 551. The detected surface temperature is inputted into a temperature control circuit of a control unit (not shown). Based on the detected surface temperature of the fixing belt 510, the temperature control circuit controls the electricity supply circuit that supplies current to the heater 512, and maintains the surface temperature of the fixing belt 510 to a desired fixing temperature.

Similarly, the heater 522 provided inside the pressure belt 520 is applied with current by an electricity supply circuit (not shown). That is, the heater 522 heats the pressure belt 520 from inside. The surface temperature of the heated pressure belt 520 is detected by the thermistor 561. The detected surface temperature is inputted into a temperature control circuit of the control unit (not shown). Based on the detected surface temperature of the pressure belt 520, the temperature control circuit controls the electric supply circuit that supplies current to the heater 522, and maintains the surface temperature of the pressure belt 520 to the desired fixing temperature. In this regard, it is also possible not to provide a heat source inside the pressure belt 520. In this case, heating is performed only on the fixing belt 510 side.

Figure 9:
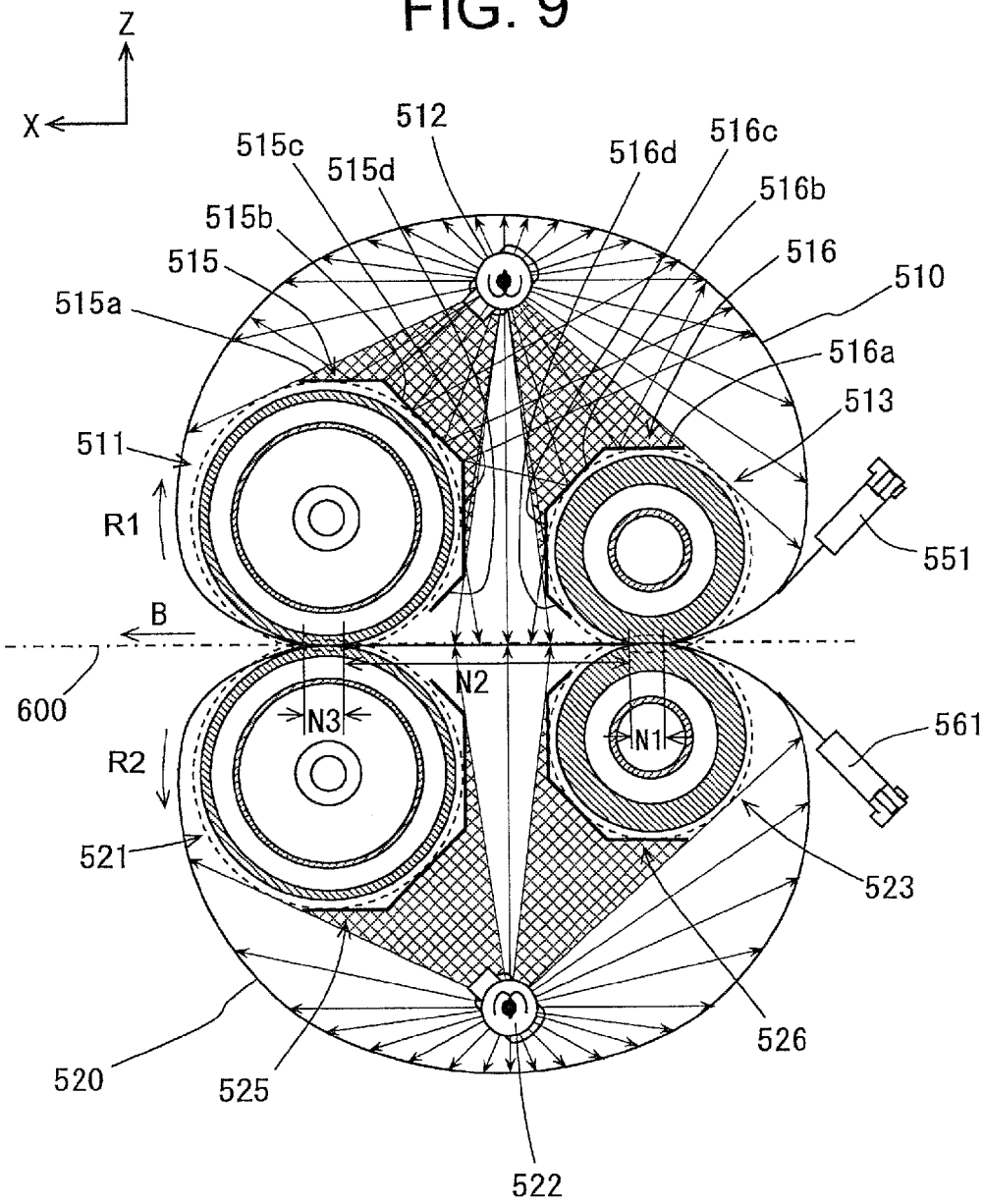
FIG. 9 is a schematic view showing directions of light emitted by a heater according to Embodiment 1.

FIG. 9 is a schematic view showing directions of light emitted by the heaters 512 and 522. Irradiation by the heaters 512 and 522 will be described with reference to FIG. 9.

The light emitted by the heater 512 provided inside the fixing belt 510 radially spreads, and is directly incident on the inner circumferential surface of the fixing belt 510 except for the light proceeding in cross-hatched regions (i.e., regions where the light proceeds toward the reflecting plates 515 and 516). That is, the light emitted by the heater 512 is directly incident on the inner circumferential surface of the fixing belt 510 at a region ranging from a position where the fixing belt 510 starts facing the heater 512 in downstream of the driving roller 511 (in the rotating direction of the fixing belt 510) to a position where the fixing belt 510 terminates facing the heater 512 in upstream of the driven roller 513, and at the nip portion N2 facing the heater 512. In this way, heat is supplied to the fixing belt 510. Similarly, light emitted by the heater 522 provided inside the pressure belt 520 radially spreads, and is directly incident on the inner circumferential surface of the pressure belt 520 except for the light proceeding in cross-hatched regions (i.e., regions where the light proceeds toward the reflecting plates 525 and 526). In this way, heat is supplied to the pressure belt 520.

Next, description will be made of directions of light reflected by the reflecting plate 515 and the reflecting plate 516 (i.e., light that proceeds in the cross-hatched regions). The reflecting plate 515 and the reflecting plate 516 are provided for preventing the driving roller 511 and the driven roller 513 from being directly irradiated with light emitted by the heater 512.

The light emitted by the heater 512 and reflected by the reflecting surface 515*a* of the reflecting plate 515 is incident on a portion of the fixing belt 510 located upstream of the heater 512 in the rotating direction of the fixing belt 510, in accordance with a relationship between an incident angle and a reflecting angle. That is, heat is supplied to this portion of the fixing belt 510. In this regard, the reflecting surface 515*a* (inclined by 45 degrees with respect to the reflecting surface 515*b*) is provided for making the reflected light incident on a wider region of the inner circumferential surface of the fixing belt 510.

The light emitted by the heater 512 and reflected by the reflecting surface 515*b* of the reflecting plate 515 is incident on a portion of the fixing belt 510 located downstream of the heater 512 and located upstream of the driven roller 513 in the rotating direction of the fixing belt 510, in accordance with a relationship between an incident angle and a reflecting angle. That is, heat is supplied to this portion of the fixing belt 510. The reflecting plate 516 facing the driven roller 513 is provided closer to the nip base line 600 than the reflecting plate 515 is. Therefore, the light reflected by the reflecting surface 515*b* of the reflecting plate 515 is not blocked by the reflecting plate 516, and is incident on the fixing belt 510.

The light emitted by the heater 512 and reflected by the reflecting surface 515*c* of the reflecting plate 515 is incident on the nip portion N2 of the fixing belt 510, in accordance with a relationship between an incident angle and a reflecting angle. That is, heat is supplied to the nip portion N2 of the fixing belt 510. The light emitted by the heater 512 is not directly incident on the reflecting surface 515*d* of the reflecting plate 515. However, the reflecting surface 515*d* reflects the light from the reflecting plate 516 (described later) toward the nip portion N2, and prevents the driving roller 511 from being irradiated.

The light emitted by the heater 512 and reflected by the reflecting surface 516*a* of the reflecting plate 516 is incident on a portion of the fixing belt 510 located downstream of the heater 512 in the rotating direction of the fixing belt 510, in accordance with a relationship between an incident angle and a reflecting angle. That is, heat is supplied to this portion of the fixing belt 510. In this regard, the reflecting surface 516*a* (inclined by 45 degrees with respect to the reflecting surface 516*b*) is provided for making the reflected light incident on a wider region of the inner circumferential surface of the fixing belt 510.

The light emitted by the heater 512 and reflected by the reflecting surface 516*b* of the reflecting plate 516 is incident on a portion of the fixing belt 510 located upstream of the heater 512 in the rotating direction of the fixing belt 510, in accordance with a relationship between an incident angle and a reflecting angle. A part of the reflect light is directly incident on the fixing belt 510. Another part of the reflected light is incident on and reflected by the reflecting surface 515*b* and the reflecting surface 515*c* of the reflecting plate 515 located closer to the nip base line 600 than the reflecting plate 516 is. The light reflected by the reflecting surface 515*b* and the reflecting surface 515*c* is incident on portions of the fixing belt 510 located upstream and downstream of the heater 512. That is, heat is supplied to these portions of the fixing belt 510.

Figure 10:
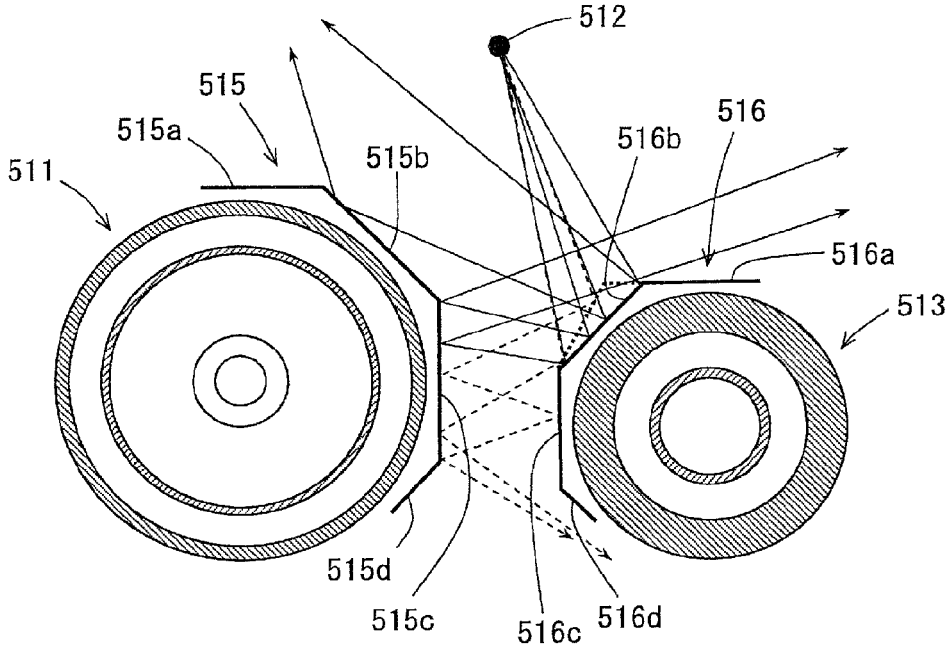
FIG. 10 is a schematic view showing directions of light reflected by a reflecting surface according to Embodiment 1.

Here, directions of light changed by inclination of the reflecting surface 516*b* will be described with reference to FIG. 10.

If an inclination angle of the reflecting surface 516*b* with respect to the reflecting surface 516*c* (shown by a dotted line in FIG. 10) is set to an appropriate angle smaller than 45 degrees (shown by a solid line in FIG. 10), the light emitted by the heater 512 and reflected by the reflecting surface 516*b* is further reflected by the reflecting surface 515*c* (or repeatedly reflected between the reflecting surface 515*c* and the reflecting surface 516*c*) as shown by a dashed line, and is incident on the nip portion N2 of the fixing belt 510 (FIG. 9). That is, heat is supplied to nip portion N2 of the fixing belt 510.

As described above, the reflecting surface 515*c* of the reflecting plate 515 faces the boundary portion 516*e* (i.e., a bent portion) between the reflecting surface 516*c* and the reflecting surface 516*b* of the reflecting plate 516 in the conveying direction of the recording sheet 101. In other words, the reflecting surface 515*c* extends toward the heater 512 with respect to the boundary portion 516*e*. By appropriately setting the inclination angle of the reflecting surface 516*b*, desired portions of the fixing belt 510 can be irradiated with (i.e., heated by) the light reflected by the reflecting surface 516*b*. The same effect can be obtained using the reflecting surface 526*b* of the reflecting plate 526.

The light emitted by the heater 512 and reflected by the reflecting surface 516*c* is incident on the nip portion N2 of the fixing belt 510 in accordance with a relationship between an incident angle and a reflecting angle. That is, heat is supplied to the nip portion N2 of the fixing belt 510. The reflecting surface 516*d* of the reflecting plate 516 is not directly irradiated with the light emitted by the heater 512. The reflecting surface 516*d* has a function to reflect the light from the reflecting plate 515, and prevents the light form being directly incident on the driven roller 513.

The reflecting plate 515 is disposed so as not to get closer to the driving roller 511 beyond a certain region (i.e., a to-be-protected region) around the driving roller 511 shown by a dashed line in FIG. 9. The reflecting surface 515*a* has a sufficient width (i.e., a length to an end portion) to prevent the light emitted by the heater 512 from directly entering the to-be-protected region around the driving roller 511. Similarly, the reflecting plate 525 is disposed so as not to get closer to the driven roller 513 beyond a certain region (i.e., a to-be-protected region) around the driven roller 513 shown by a dashed line in FIG. 9. The reflecting surface 516*a* has a sufficient width (i.e., a length to an end portion) to prevent the light emitted by the heater 512 from directly entering the to-be-protected region around the driven roller 513.

In this embodiment, the pressure belt 520, the pressure roller 521, the driven pressure roller 523, the heater 522, the reflecting plate 525 and the reflecting plate 526 are configured plane-symmetrically with the driving roller 511, the driven roller 513, the heater 512, the reflecting plate 515 and the reflecting plate 516 with respect to a nip plane (i.e., a plane through which the nip base line 600 is defined). Therefore, light proceeds inside the pressure belt 520 in a similar manner to that inside the fixing belt 510. For this reason, explanation of the light inside the pressure belt 520 will be omitted.

With such a configuration, when the recording sheet 101 to which the toner image has been transferred reaches the fixing nip region 529 (including the nip portion N1, the nip portion N2 and the nip portion N3), the recording sheet 101 is conveyed through the nip portion N1, the nip portion N2 and the nip portion N3 as shown by the arrow P, and is applied with heat and pressure. That is, a fixing process is performed. In this process, a large part of the heat accumulated in the fixing belt 510 and the pressure belt 520 is supplied to the recording sheet 101 at the nip portion N1. However, the heat is supplied (replenished) by irradiation at the nip portion N2. Therefore, the fixing process is performed with sufficient heat at the nip portion N3, i.e., a main nip portion.

Figure 11:
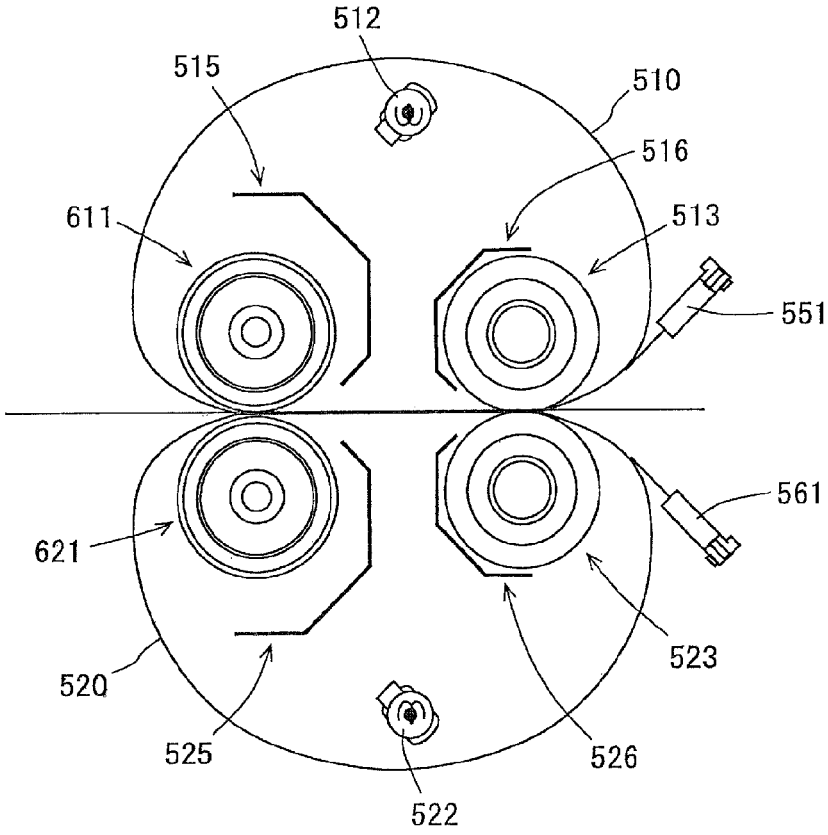
FIG. 11 is a schematic view showing a configuration of a fixing unit according to a modification of Embodiment 1.

FIG. 11 shows a configuration of a fixing unit according to a modification of this embodiment. The fixing unit of this modification is different from the fixing unit 500 shown in FIG. 4 in outer diameters of a driving roller 611 and a pressure roller 621. In this modification, the driving roller 611 and the pressure roller 621 are substantially the same as those of a driven roller 513 and a driven pressure roller 523. Other configurations are the same as those of fixing unit 500 shown in FIG. 4.

The reflecting plate 515 and the reflecting plate 525 are not necessarily provided along the outer circumferential surfaces of the driving roller 611 and the pressure roller 621, but may be provided further apart from the outer circumferential surfaces of the driving roller 611 and the pressure roller 621. The fixing belt 510 and the pressure belt 520 are heated by the heaters 512 and 522 in a similar manner as in the fixing unit 500 shown in FIG. 4.

As described above, according to the fixing unit 500 of Embodiment 1 of the present invention, a larger area of the fixing belt 510 can be directly or indirectly irradiated with the light emitted by the heater 512 while preventing the driving roller 511 and the driven roller 513 from being irradiated with the light emitted by the heater 512. Therefore, the fixing belt 510 can be efficiently heated particularly at the nip portion N2 between the driving roller 511 and the driven roller 513. Same can be said to the pressure belt 520. Thus, the fixing process can be performed with the sufficient heat at the nip portions N1, N2 and N3, and therefore stable fixing property can be achieved. That is, fixing property can be enhanced. Further, a warm-up time for heating the fixing belt 510 and the pressure belt 520 can be reduced. These effects can be obtained by enhancement in heating efficiency, and are not accompanied by increase in a running cost.

Embodiment 2

Figure 12:
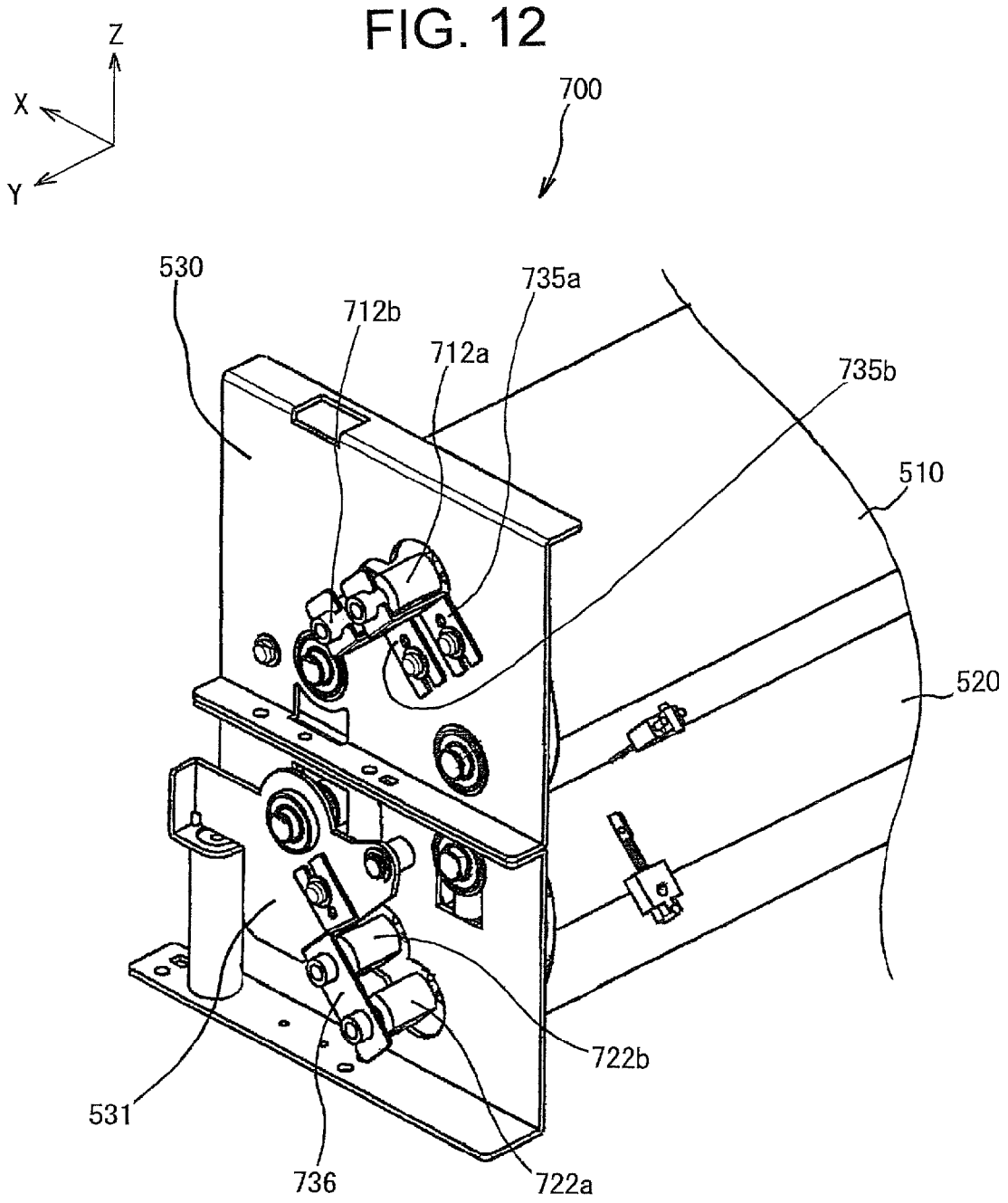
FIG. 12 is a perspective view showing a left end portion of a fixing unit according to Embodiment 2.
Figure 13:
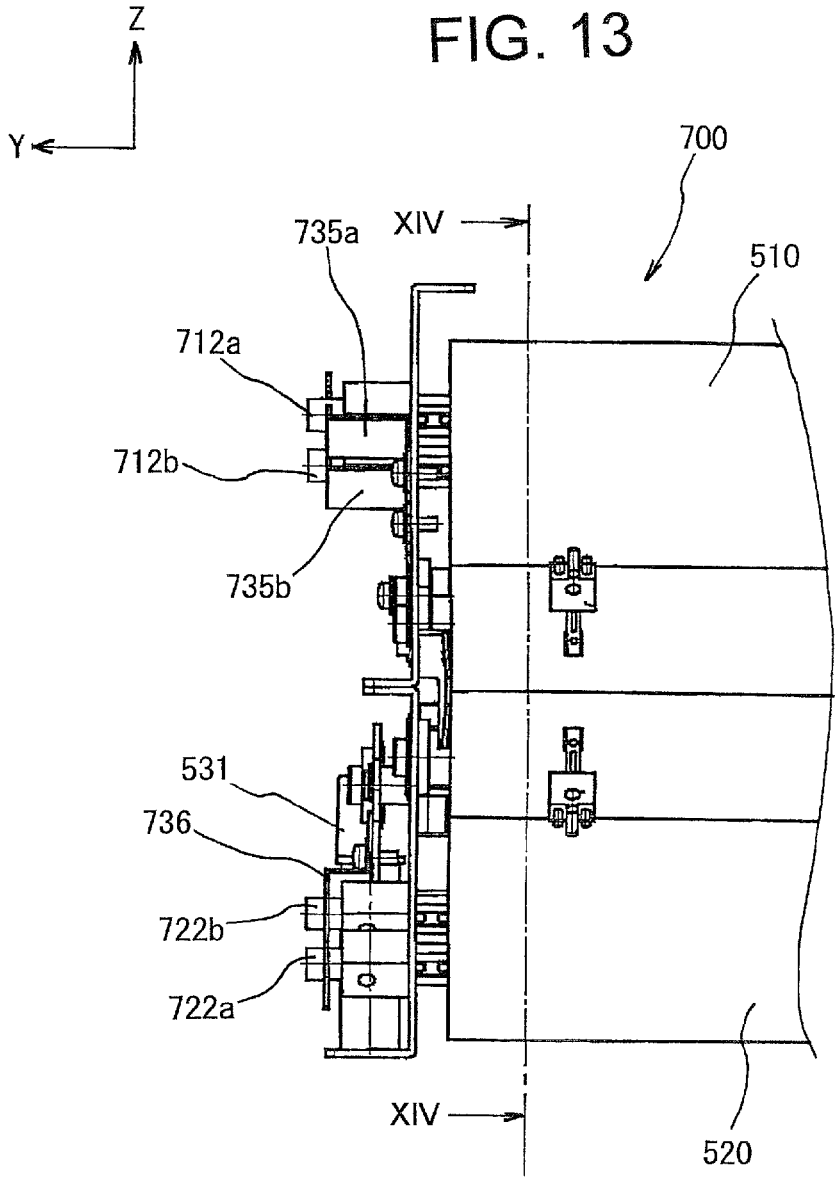
FIG. 13 is a front view showing the left end portion of the fixing unit shown in FIG. 12 as seen from −X side.
Figure 14:
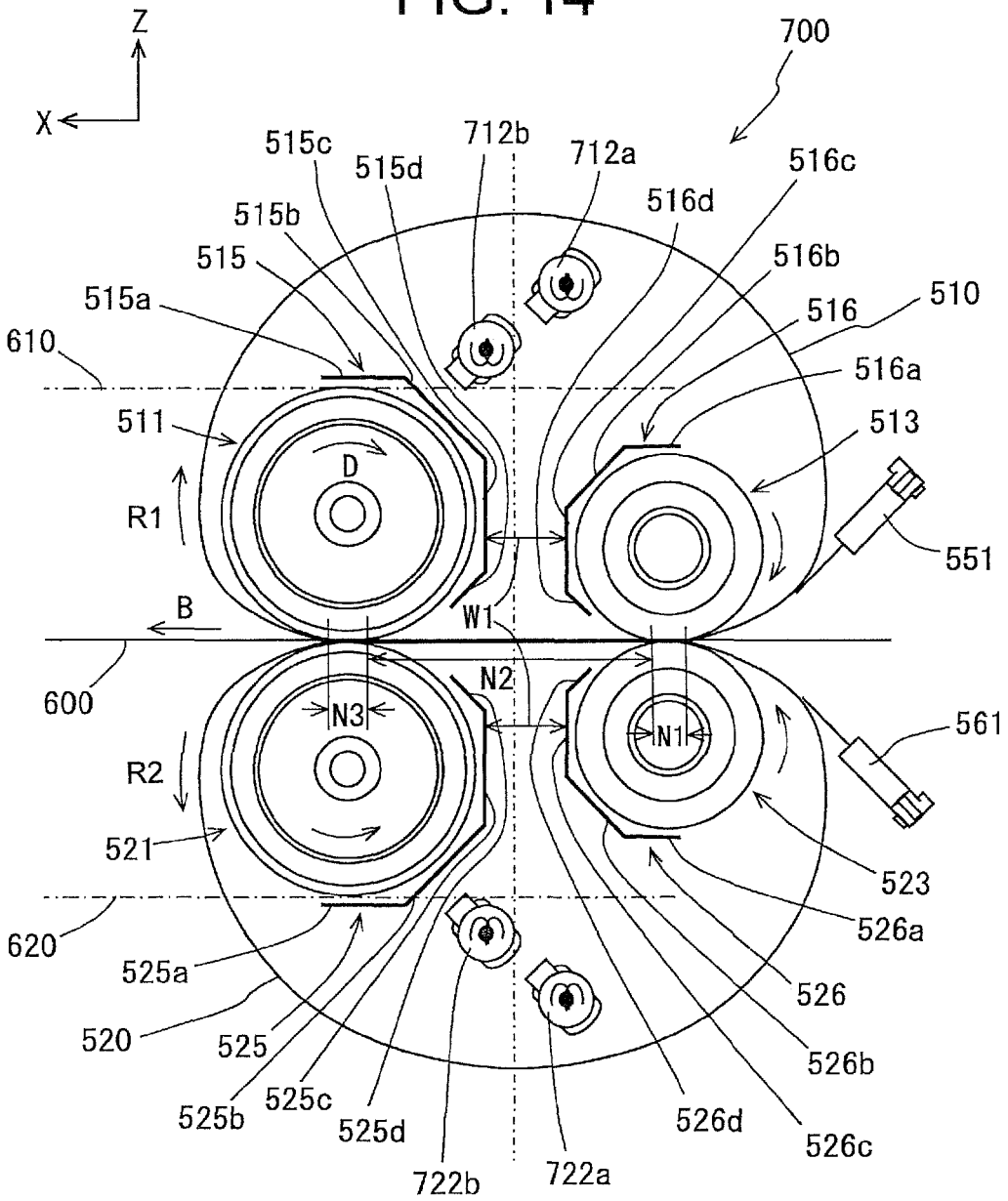
FIG. 14 is a sectional view of a fixing unit according to Embodiment 2 taken along a plane indicated by line XIV-XIV in FIG. 13.

FIG. 12 is a perspective view showing a left end portion of a fixing unit 700 according to Embodiment 2. FIG. 13 is a front view of the left end portion of the fixing unit 700 shown in FIG. 12 as seen from −X side. FIG. 14 is a sectional view of the fixing unit 700 taken along a plane indicated by line XIV-XIV in FIG. 13. The fixing unit 700 will be described with reference to FIGS. 12 through 14.

An image forming apparatus including the fixing unit 700 is different from the image forming apparatus 1000 including the fixing unit 500 (FIG. 4) of Embodiment 1 in that the fixing unit 700 includes first heaters 712*a* and 722*a* and second heaters 722*a* and 722*b*. Components that are the same as those of the image forming apparatus 1000 (FIG. 1) of Embodiment 1 are assigned with the same reference numerals or omitted in the drawings, and description will be mainly made of differences from Embodiment 1. The image forming apparatus of Embodiment 2 has the same configuration as that of the image forming apparatus 1000 of Embodiment 1 except for the fixing unit 700, and therefore FIG. 1 will be referred as necessary.

The fixing unit 700 of Embodiment 2 includes a plurality of heaters for recording sheets 101 of different sizes. To be more specific, the fixing unit 700 includes two first heaters 712*a* and 722*a* for a wider recording sheet 101 and two second heaters 712*b* and 722*b* for a narrower recording sheet 101. Components provided inside the fixing belt 510 are configured plane-symmetrically with the components provided inside the pressure belt 520 with respect to the nip plane (through which the nip base line 600 is defined). Therefore, the components provided inside the fixing belt 510 will be mainly described. The components provided inside the pressure belt 520 will be referred to as necessary.

As shown in FIG. 14, the first heater 712*a* and the second heater 712*b* are provided inside the fixing belt 510, and are located on an outer side (on a side opposite to the fixing nip portion 529) with respect to the tangential line 610 of the driving roller 511 parallel to the nip base line 600 (i.e., parallel to the X direction). The first heater 712*a* is located upstream of the second heater 712*b* in the conveying direction of the recording sheet 101 shown by the arrow B. The first heater 712*a* is located on the outer side (on a side opposite to the fixing nip portion 529) with respect to the second heater 712*b*. The heaters 712*a* and 712*b* are located so that light emitted by the heaters 712*a* and 712*b* are directly or indirectly (i.e., while being reflected by the reflecting surfaces 515*c* and 516*c*) incident on the nip portion N2 of the fixing belt 510 through the gap W1. The first heater 722*a* and the second heater 722*b* are provided inside the pressure belt 520, and are located in a similar manner to the first heater 712*a* and the second heater 712*b* inside the fixing belt 510.

As shown in FIG. 12, the first heater 712*a* has end portions supported by heater support portions 735*a* (one of which is shown in FIG. 12) provided on the brackets 530. The second heater 712*b* has end portions supported by the heater support portions 735*b* (one of which is shown in FIG. 12) provided on the brackets 530. The first heater 722*a* and the second heater 722*b* respectively have end portions supported by heater support portions 736 (one of which is shown in FIG. 12) provided on the pressure roller levers 531.

Figure 15:
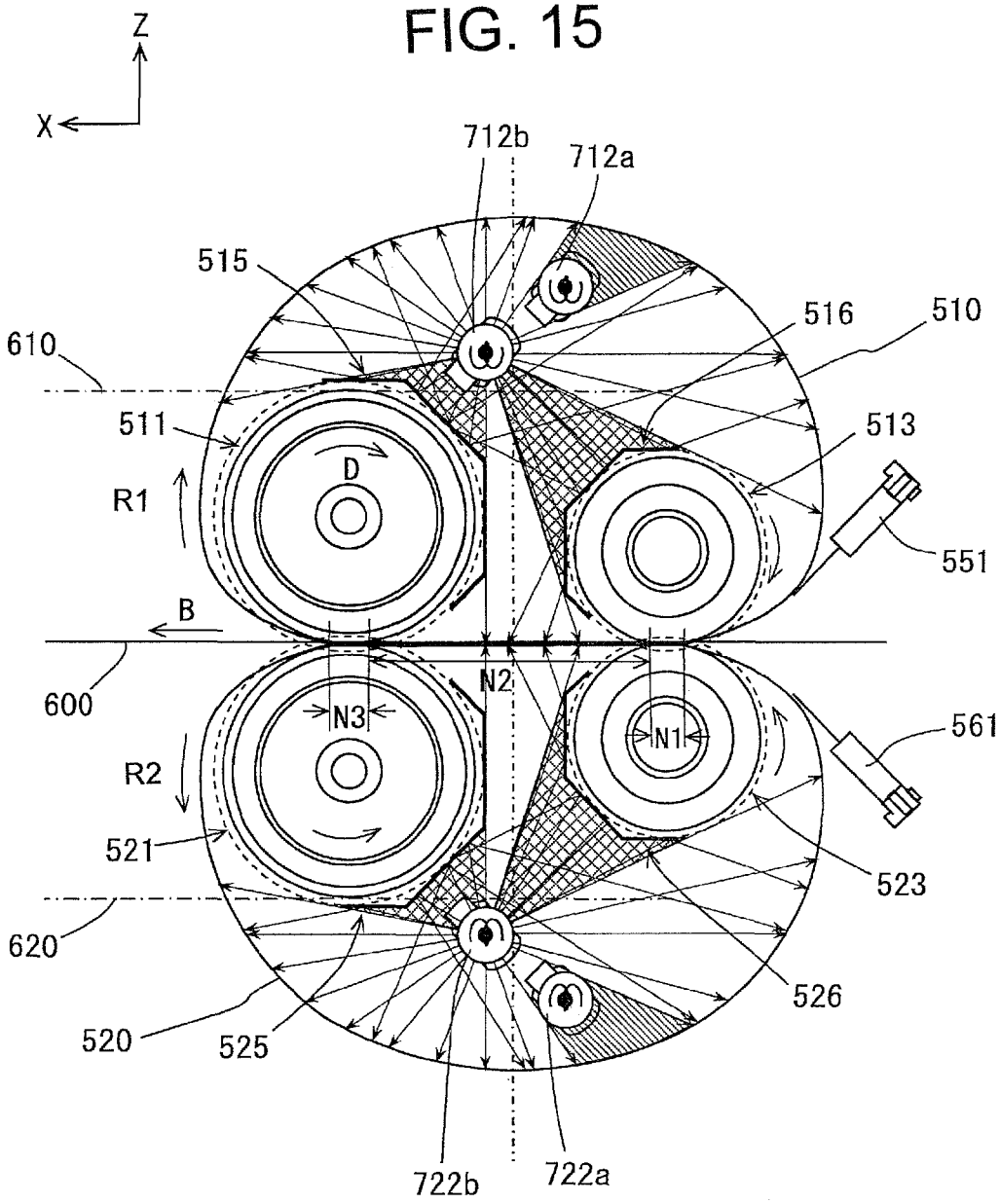
FIG. 15 is a schematic view showing directions of light emitted by a second heater according to Embodiment 2.

FIG. 15 is a schematic view showing directions of light emitted by the second heaters 712*b* and 722*b*. Irradiation by the second heaters 712*b* and 722*b* will be described with reference to FIG. 15.

The light emitted by the second heater 712*b* provided inside the fixing belt 510 radially spreads, and is directly incident on the inner circumferential surface of the fixing belt 510 except for the light proceeding in cross-hatched regions (i.e., regions where the light proceeds toward the reflecting plates 515 and 516) and a hatched region where the light proceeds toward the first heater 712*a*. To be more specific, the light emitted by the second heater 712*b* is directly incident on the inner circumferential surface of the fixing belt 510 at a region ranging from a position where the fixing belt 510 starts facing the second heater 712*b* in downstream of the driving roller 511 (in the rotating direction of the fixing belt 510) to a position where the fixing belt 510 terminates facing the second heater 712*b* in upstream of the first heater 712*a*, a region ranging from a position where the fixing belt 510 starts facing the second heater 712*b* in downstream of the first heater 712*a* to a position where the fixing belt 510 terminates facing the second heater 712*b* in upstream of the driven roller 511, and at the nip portion N2 facing the first heater 712*a*. In this way, the heat is supplied to the inner circumferential surface of the fixing belt 510. The light proceeding in the cross-hatched regions are reflected by the reflecting plates 515 and 516 as described in Embodiment with reference to FIG. 9, and therefore further explanation is omitted.

Similarly, the light emitted by the second heater 722*b* provided inside the pressure belt 520 radially spreads, and is directly incident on the inner circumferential surface of the pressure belt 520 except for the light proceeding in cross-hatched regions (i.e., regions where the light proceeds toward the reflecting plates 525 and 526) and a hatched region where the light proceeds toward the first heater 722*a*. In this way, the heat is supplied to the inner circumferential surface of the pressure belt 520.

Figure 16:
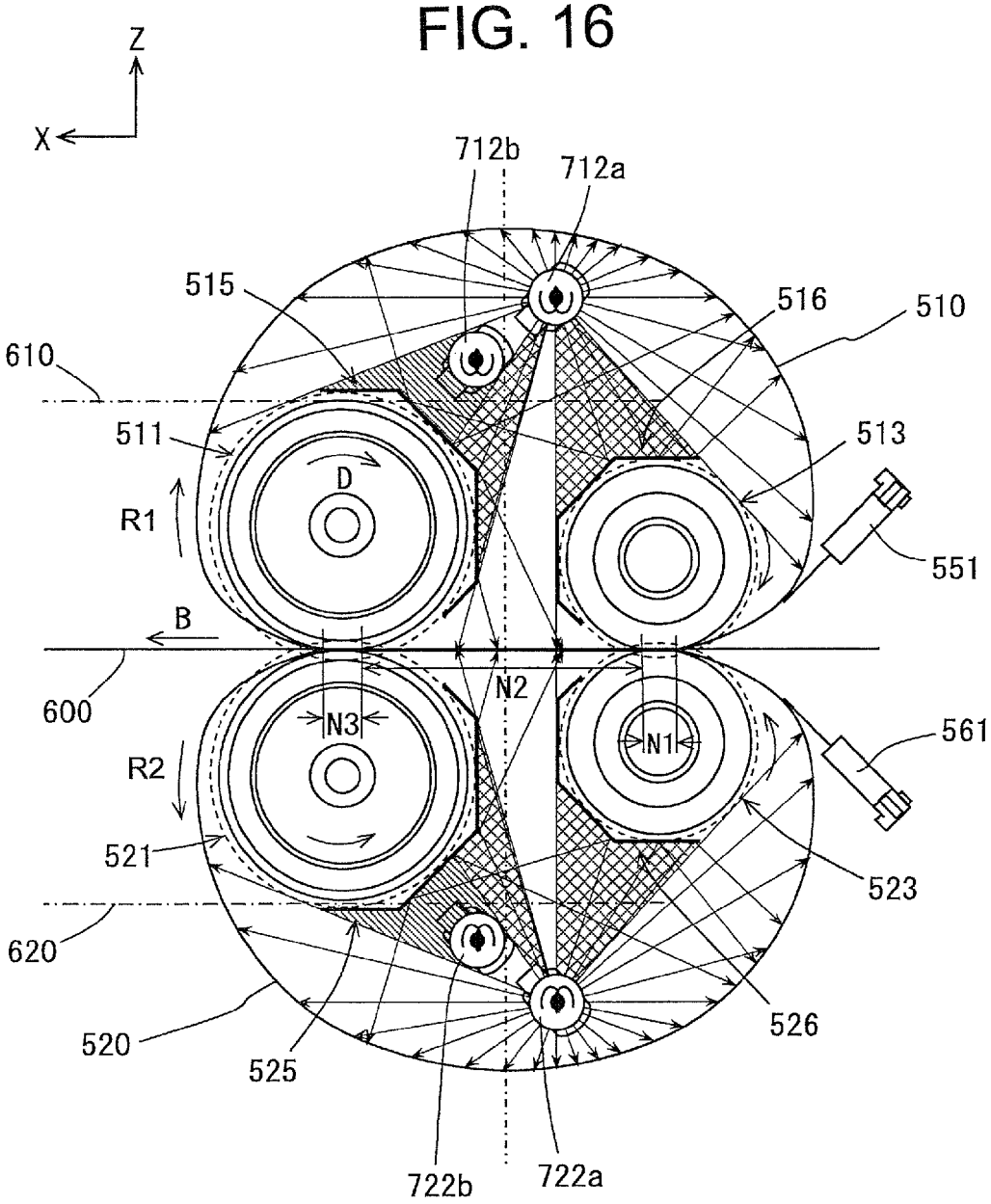
FIG. 16 is a schematic view showing directions of light emitted by a first heater according to Embodiment 2.

FIG. 16 is a schematic view showing directions of the light emitted by the first heaters 712*a* and 722*a*. Irradiation by the first heaters 712*a* and 722*a* will be described with reference to FIG. 16.

The light emitted by the first heater 712*a* provided inside the fixing belt 510 radially spreads, and is directly incident on the inner circumferential surface of the fixing belt 510 except for the light proceeding in cross-hatched regions (i.e., regions where the light proceeds toward the reflecting plates 515 and 516) and a hatched region where the light proceeds toward the second heater 712*b*. To be more specific, the light emitted by the first heater 712*a* is directly incident on the inner circumferential surface of the fixing belt 510 at a region ranging from a position where the fixing belt 510 starts facing the first heater 712*a* in downstream of the driving roller 511 (in the rotating direction of the fixing belt 510) to a position where the fixing belt 510 terminates facing the first heater 712*a* in upstream of the driven roller 513, and at the nip portion N2 facing the first heater 712*a*. In this way, heat is supplied to the inner circumferential surface of the fixing belt 510. In this case, the cross-hatched portion (where the light proceeds toward the reflecting plate 515) and the hatched portion (where the light proceeds toward the second heater 712*b*) overlap each other, and therefore existence of the second heater 712*b* does not cause loss of light directly incident on the fixing belt 510. The light proceeding in the cross-hatched regions are reflected by the reflecting plates 515 and 516 as described in Embodiment 1 with reference to FIG. 9, and therefore further explanation is omitted.

Similarly, the light emitted by the first heater 722*a* provided inside the pressure belt 520 radially spreads, and is directly incident on the inner circumferential surface of the pressure belt 520 except for the light proceeding in cross-hatched regions (i.e., regions where the light proceeds toward the reflecting plates 525 and 526) and a hatched region where the light proceeds toward the second heater 722*b*. In this way, heat is supplied to the inner circumferential surface of the pressure belt 520.

Therefore, when the recording sheet 101 to which the toner image has been transferred reaches the fixing nip region 529 (including the nip portion N1, the nip portion N2 and the nip portion N3), the recording sheet 101 is conveyed through the nip portion N1, the nip portion N2 and the nip portion N3 as shown by the arrow B, and is applied with heat and pressure (i.e., a fixing process is performed). In this process, a large part of the heat accumulated in the fixing belt 510 and the pressure belt 520 is supplied to the recording sheet 101 at the nip portion N1. However, the heat is supplied by irradiation at the nip portion N2. Therefore, the fixing process is performed with sufficient heat at the nip portion N3, i.e., a main nip portion.

As described above, according to the fixing unit 700 of Embodiment 2 of the present invention, even in a configuration in which two heat sources are provided corresponding to the recording sheets 101 of different sizes, the fixing belt 510 can be efficiently heated at the nip portion N2 between the driving roller 511 and the driven roller 513. Same can be said to the pressure belt 520. Thus, the fixing process can be performed with the sufficient heat at the respective nip portions N1, N2 and N3, and therefore stable fixing property can be achieved. That is, fixing property can be enhanced. Further, a warm-up time for heating the fixing belt 510 and the pressure belt 520 can be reduced.

Embodiment 3

Figure 17:
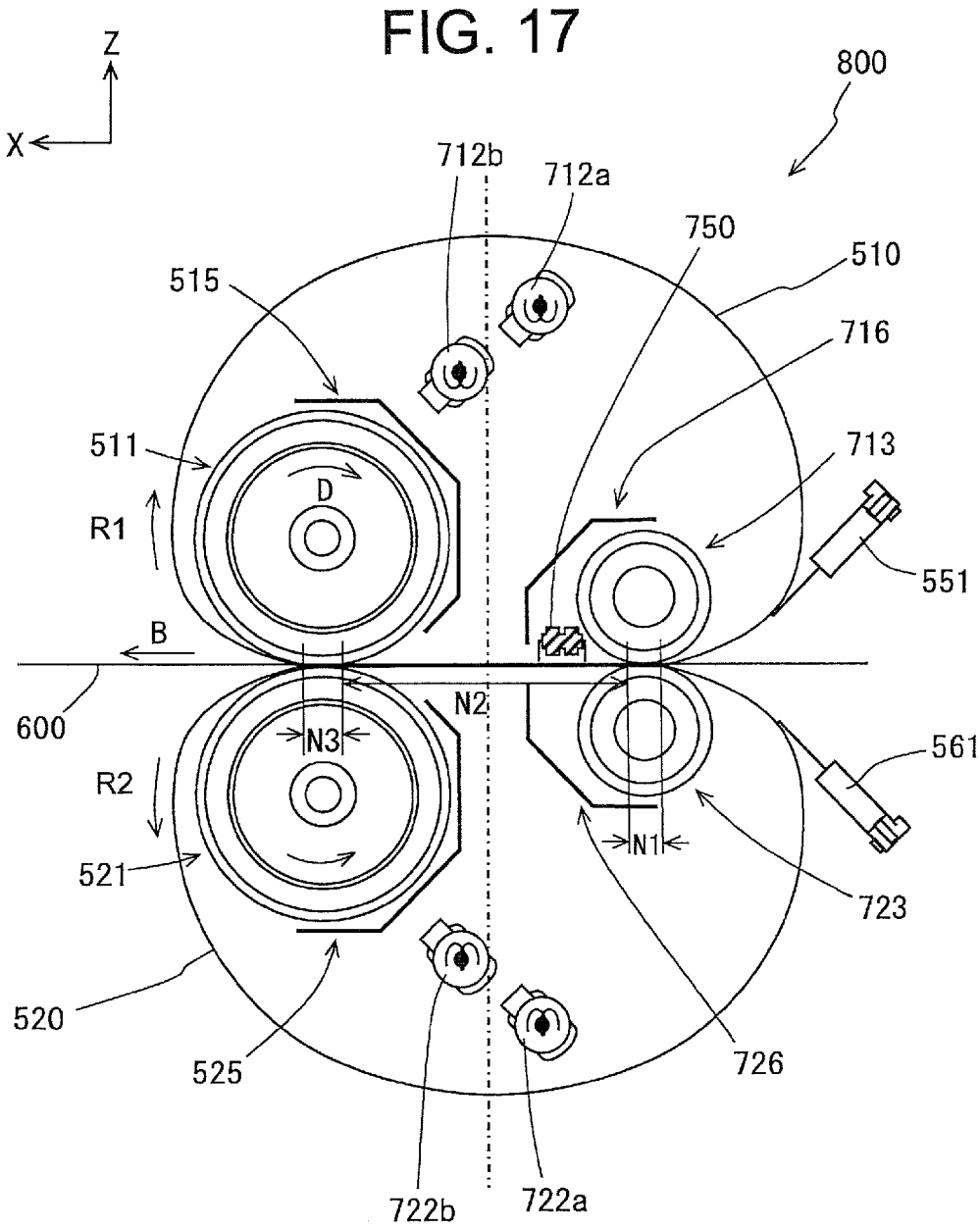
FIG. 17 is a sectional view a fixing unit according to Embodiment 3 taken along a plane which is the same as that indicated by line XIV-XIV in FIG. 13.

FIG. 17 is a sectional view of a fixing unit 800 according to Embodiment 3 of the present invention taken along a plane which is the same as that indicated by line XIV-XIV in FIG. 13.

The fixing unit 800 is different from the fixing unit 700 (FIG. 14) of Embodiment 2 in that the fixing unit 800 includes a thermistor 750 provided downstream of a driven roller 713 in the rotating direction of the fixing belt 510. The thermistor 750 is provided for detecting a temperature of the inner circumferential surface of the fixing belt 510. For the purpose of providing the thermistor 750, outer diameters of the driven roller 713 and the driven pressure roller 723 are set to be smaller than those of Embodiment 2, and reflecting plates 715 and 716 have shapes different from those of Embodiment 2. Components that are the same as those of the fixing unit 700 (FIG. 14) of Embodiment 2 are assigned with the same reference numerals or omitted in the drawings, and description will be mainly made of differences from the fixing unit 700 of Embodiment 2.

As shown in FIG. 17, the thermistor 750 as a temperature detection unit is provided downstream of the driven roller 713 for detecting the temperature of the inner circumferential surface of the fixing belt 510. The thermistor 750 is located on an inner side of the reflecting plate 716. The thermistor 750 is covered by the reflecting plate 716 so that light emitted by the first heater 712*a* and the second heater 712*b* are not directly incident on the thermistor 750.

The driven roller 713 and the driven pressure roller 723 (i.e., a second roller pair) are located at an upstream end of the fixing nip region 529 in the conveying direction of the recording sheet 101 shown by the arrow B. The driven roller 713 and the driven pressure roller 723 have resilient layers formed of foaming silicone rubber having heat resistance and heat insulating property. In this regard, the resilient layers of the driven roller 713 and the driven pressure roller 723 do not completely insulate heat. Therefore, when the driven roller 713 and the driven pressure roller 723 start rotating, the driven roller 713 and the driven pressure roller 723 may draw heat from the fixing belt 510 and the pressure belt 520 until the driven roller 713 and the driven pressure roller 723 reach a saturated temperature.

Therefore, in Embodiment 3, the thermistor 750 is provided downstream of the driven roller 713 for detecting the temperature of the fixing belt 510. Light emission of the first heater 712*a* and the second heater 712*b* are controlled so as to compensate for decrease in temperature of the detected temperature of the fixing belt 510. Light emitted by the first heater 712*a* and the second heater 712*b* are incident on the nip portion N2 formed by the fixing belt 510 and the pressure belt 520 having appropriate rigidity and flexibility. Therefore, heat is supplied to the fixing belt 510 and the pressure belt 520.

In Embodiment 3, two heaters 712*a* and 712*b* are provided inside the fixing belt 510, and two heaters 722*a* and 722*b* are provided inside the pressure belt 520. However, it is also possible to provide only one heater respectively in the fixing belt 510 and in the pressure belt 520.

Further, in Embodiment 3, the thermistor 750 detects the temperature of the fixing belt 510, and the heaters 712*a* and 712*b* inside the fixing belt 510 are controlled based on the temperature detected by the thermistor 750. However, it is also possible to provide a thermistor for detecting a temperature of the pressure belt 520. In such a case, the heaters 722*a* and 722*b* are controlled based on the temperature detected by the thermistor. Further, it is also possible to provide thermistors for detecting both temperatures of the fixing belt 510 and the pressure belt 520. In such a case, the heaters 712*a* and 712*b* and the heaters 722*a* and 722*b* are controlled based on the temperatures detected by the thermistors.

As described above, according to the fixing unit 800 of Embodiment 3, decrease in temperature of the fixing belt 510 and/or the pressure belt 520 is detected, and the heaters are controlled based on the detected temperature. The heat drawn from the fixing belt 510 and the pressure belt 520 by the driven roller 713 and the driven pressure roller 723 can be compensated by heat supplied by irradiation at the nip portion N2 by the heaters. Therefore, the fixing process can be performed with the sufficient heat at the respective nip portions N1, N2 and N3, and therefore stable fixing property can be achieved. That is, fixing property can be enhanced.

In the above described embodiments, the belts (having endless shapes) are provided on a fixing section (i.e., an upper side of the conveying path of the recording sheet) and a pressure section (i.e., a lower side of the conveying path of the recording sheet). However, the present invention is not limited to such a configuration. For example, it is also possible to provide the belt only on the fixing section. In such a case, the pressure section can be constituted by a roller. Alternatively, it is also possible to provide the belt only on the pressure section. In such a case, the fixing section can be constituted by a roller. It is only necessary that the fixing device (i.e., the fixing unit) includes at least one belt and a heater provided inside the belt.

Further, in the above described embodiments, the halogen lamp is used as each heat source. However, the heat source is not limited to the halogen lamp. It is only necessary that transmission of heat generated by the heat source can be controlled by the reflecting plate as is the case with light.

In the above described embodiments, the present invention is applied to the color electrophotographic color printer as an example of the image forming apparatus. However, the present invention is not limited to such a configuration. The present invention is also applicable to an image forming apparatus such as a copier, a facsimile machine or an MFP (Multi-Function Peripheral) that forms an image on a recording medium. Further, the present invention is also applicable to an image forming apparatus that forms a monochromatic image.

What is claimed is:

1. A fixing device comprising:

an endless fixing belt;

a first roller provided on an inner circumference side of the fixing belt;

a second roller provided on the inner circumference side of the fixing belt and located upstream of the first roller in a conveying direction of a recording medium;

a heat source provided on the inner circumference side of the fixing belt;

a first reflecting portion provided between the heat source and the first roller, the first reflecting portion including a first reflecting surface; and a second reflecting portion provided between the heat source and the second roller, the second reflecting portion being provided apart from the first reflecting portion, the second reflecting portion including a second reflecting surface, wherein the first reflection portion includes a third reflecting surface inclined with respect to the first reflecting surface, and a first boundary portion provided between the first reflecting surface and the third reflecting surface.

2. The fixing device according to claim 1, wherein the first reflecting surface and the second reflecting surface face each other in the conveying direction of the recording medium.

3. The fixing device according to claim 1, wherein the second reflecting portion includes a fourth reflecting surface inclined with respect to the second reflecting surface, and a second boundary portion provided between the second reflecting surface and the fourth reflecting surface.

4. The fixing device according to claim 3, wherein the first boundary portion is closer to the heat source than the second boundary portion is.

5. The fixing device according to claim 1, wherein the fixing belt is driven by the first roller to rotate in such a manner that a part of the fixing belt between the first roller and the second roller moves in the conveying direction of the recording medium, wherein the first reflecting portion includes a third reflecting surface provided continuously from the first reflecting surface, the third reflecting surface reflecting light from the heat source toward at least a part of the fixing belt ranging from downstream of the heat source to upstream of the second roller in a rotating direction of the fixing belt, and wherein the third reflecting surface protrudes toward the heat source with respect to the second reflecting portion in a direction perpendicular to the conveying direction of the recording medium.

6. The fixing device according to claim 1, wherein the second reflecting portion includes a fourth reflecting surface provided continuously form the second reflecting surface, the fourth reflecting surface being inclined with respect to the second reflecting surface in a direction away from the first reflecting portion, wherein the first reflecting surface faces a boundary portion between the second reflecting surface and the fourth reflecting surface in the conveying direction of the recording medium.

7. The fixing device according to claim 6, wherein the fixing belt is driven by the first roller to rotate in such a manner that a part of the fixing belt between the first roller and the second roller moves in the conveying direction of the recording medium, and wherein the fourth reflecting surface reflects light from the heat source toward at least a part of the fixing belt ranging from downstream of the first roller to upstream of the heat source in a rotating direction of the fixing belt.

8. The fixing device according to claim 6, wherein the fourth reflecting surface reflects light from the heat source in a direction away from the heat source toward the first reflecting surface.

9. The fixing device according to claim 1, wherein the fixing belt is driven by the first roller to rotate in such a manner that a part of the fixing belt between the first roller and the second roller moves in the conveying direction of the recording medium, and wherein a nip forming portion is provided so as to form a fixing nip region with the first roller, the second roller and the fixing belt in a region where the part of the fixing belt moves in the conveying direction of the recording medium.

10. The fixing device according to claim 9, wherein the first reflecting surface and the second reflecting surface extend in a direction substantially perpendicular to the rotating direction of the fixing belt at the fixing nip region.

11. The fixing device according to claim 10, wherein the first reflecting portion includes a third reflecting surface inclined with respect to the first reflecting surface.

12. The fixing device according to claim 1, wherein the fixing belt has rigidity and flexibility.

13. The fixing device according to claim 1, wherein a plurality of the heat sources is provided.

14. The fixing device according to claim 1, wherein the fixing belt is driven by the first roller to rotate in such a manner that a part of the fixing belt between the first roller and the second roller moves in the conveying direction of the recording medium, wherein a temperature detection unit is provided so as to detect a temperature of the fixing belt downstream of the second roller in a rotating direction of the fixing belt, the temperature detection unit outputting detection signal based on which the heat source is controlled.

15. The fixing device according to claim 9, wherein the nip forming portion comprises:

an endless pressure belt;

a third roller provided on an inner circumference side of the pressure belt, the third roller being pressed against the first roller via the fixing belt and the pressure belt; and a fourth roller provided on the inner circumference side of the pressure belt, the fourth roller being pressed against the second roller via the fixing belt and the pressure belt.

16. The fixing device according to claim 15, further comprising:

a second heat source provided on the inner circumference side of the pressure belt;

a third reflecting portion provided between the second heat source and the third roller; and a fourth reflecting portion provided between the second heat source and the fourth roller, wherein a gap is provided between the third reflecting portion and the fourth reflecting portion, with the second heat source facing the pressure belt through the gap.

17. The fixing device according to claim 15, wherein the first roller and the third roller have the same structure;

wherein the second roller and the fourth roller have the same structure; and wherein the fixing belt and the pressure belt have the same structure.

18. An image forming apparatus comprising the fixing device according to claim 1.

* * * * *